US006676589B2

(12) United States Patent
Küng et al.

(10) Patent No.: US 6,676,589 B2
(45) Date of Patent: Jan. 13, 2004

(54) DUNNAGE CONVERSION MACHINE WITH TRANSLATING GRIPPERS, AND METHOD AND PRODUCT

(75) Inventors: Kurt Küng, Uhwiesen (CH); Dieter Schwarz, Fislisbach (CH); Dan Coppus, Amsternrade (NL)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 09/878,130

(22) Filed: Jun. 8, 2001

(65) Prior Publication Data

US 2002/0091053 A1 Jul. 11, 2002

Related U.S. Application Data

(60) Provisional application No. 60/210,815, filed on Jun. 9, 2000.

(51) Int. Cl.[7] ..... B31B 1/00
(52) U.S. Cl. ..... 493/464; 493/967
(58) Field of Search ..... 493/461, 462, 493/463, 464, 967

(56) References Cited

U.S. PATENT DOCUMENTS

| | | | | |
|---|---|---|---|---|
| 1,293,072 A | | 2/1919 | Ford | 264/286 |
| 2,072,790 A | | 3/1937 | Apitzsch et al. | 493/409 |
| 2,785,717 A | | 3/1957 | Knowles | 144/254 |
| 2,786,399 A | | 3/1957 | Mason et al. | 493/369 |
| 2,924,154 A | | 2/1960 | Russell et al. | 493/464 |
| 3,157,551 A | | 11/1964 | Granozio | 156/471 |
| 3,509,797 A | | 5/1970 | Johnson | 493/340 |
| 3,751,541 A | | 8/1973 | Hegler | 264/508 |
| 3,876,359 A | | 4/1975 | Herr | 425/370 |
| 3,981,663 A | | 9/1976 | Lupke | 425/326.1 |
| 3,993,425 A | | 11/1976 | Dunn et al. | 425/370 |
| 4,012,932 A | | 3/1977 | Gewiss | 72/187 |
| 4,429,559 A | | 2/1984 | dePuglia et al. | 72/186 |
| 4,650,456 A | * | 3/1987 | Armington | 493/464 |
| 4,789,322 A | * | 12/1988 | Chan et al. | 425/336 |
| 4,824,354 A | * | 4/1989 | Keaton | 425/345 |
| 4,938,739 A | * | 7/1990 | Nilsson | 493/422 |
| 5,131,903 A | | 7/1992 | Levine et al. | |

(List continued on next page.)

FOREIGN PATENT DOCUMENTS

EP 0813 954 A1 12/1997

OTHER PUBLICATIONS

FASTStuff™ Packaging System User's Guide, Fast Track™ Systems L.L. C., Apr. 27, 1999 Rel:04.

*Primary Examiner*—Rinaldi I. Rada
*Assistant Examiner*—Paul R Durand
(74) *Attorney, Agent, or Firm*—Renner, Otto, Boisselle & Sklar, LLP

(57) ABSTRACT

A dunnage conversion machine for converting stock material into a dunnage product includes a forming assembly and a pulling assembly. The pulling assembly includes at least two grippers movable together through a transfer region in opposition to one another and cooperative to grip therebetween the dunnage strip for advancing the dunnage strip through the transfer region, and at least one of the grippers including an aperture operative to gather and laterally capture therein the dunnage strip as the grippers move through the transfer region. Also disclosed is a severing assembly including a movable blade and a reciprocating actuator connected to the blade by a motion transmitting assembly that moves the blade through a full severing cycle upon a stroke of the actuator in either direction. Also disclosed is a void fill dunnage product including a three dimensional crumpled strip of dunnage round in cross-section and including at least one ply of sheet material having, in cross-section, a crumpled multi-lobed undulating body, with the lobes thereof extending longitudinally and being dispersed in an irregular pattern.

35 Claims, 24 Drawing Sheets

U.S. PATENT DOCUMENTS 5,197,318 A * 3/1993 Joyce et al. ..... 72/187
5,393,211 A * 2/1995 Hegler et al. ..... 425/149
5,698,293 A 12/1997 Nordlund et al.
5,891,009 A 4/1999 Ratzel et al.
5,938,580 A * 8/1999 Siekmann ..... 493/38
5,946,994 A 9/1999 Tether et al.
5,947,886 A 9/1999 Simmons
6,022,305 A 2/2000 Choi et al.
6,076,764 A 6/2000 Robinson
6,080,097 A * 6/2000 Ratzel et al. ..... 493/359
6,179,765 B1 * 1/2001 Toth ..... 493/360
6,183,586 B1 * 2/2001 Heidelberger ..... 156/183
6,221,000 B1 * 4/2001 Weder ..... 493/463
6,402,674 B1 * 6/2002 Simmons et al. ..... 493/24
6,416,451 B1 * 7/2002 Ratzel et al. ..... 493/38

* cited by examiner

DUNNAGE CONVERSION MACHINE WITH TRANSLATING GRIPPERS, AND METHOD AND PRODUCT

RELATED APPLICATION DATA

This application claims the benefit under 35 USC 119(e) of earlier filed U.S. provisional application No. 60/210,815, filed on Jun. 9, 2000, which is hereby incorporated herein by reference in its entirety

FIELD OF THE INVENTION

The present invention relates to a dunnage conversion machine with translating grippers, and a method of converting sheet material into a dunnage product using the translating grippers, and a dunnage product.

BACKGROUND OF THE INVENTION

Various types of conversion machines heretofore have been used to convert sheet stock material composed of one or more plies of sheet material into a dunnage product. Some machines function solely to produce a void fill dunnage product, used primarily to fill voids in a packaging container to prevent the contents thereof from shifting during shipment. One objective in the design of these machines is to produce the void fill dunnage product very rapidly. Accordingly, these machines are designed to operate at relatively high speeds.

Other machines function to produce a dunnage product having cushioning characteristics which enable the dunnage product to, for example, cushion or secure an article in a container from damage which may not otherwise be obtainable from a void fill dunnage product. Such machines usually produce the dunnage product at a relatively slower rate than void fill producing conversion machines to enable deforming or shaping of the sheet material to, for example, impart adequate loft into the resulting dunnage product. Thus, with these machines often speed is sacrificed to achieve a dunnage product characterized by substantial cushioning properties. The trade off is a slower production rate of the cushioning dunnage product as compared to the void fill dunnage product.

However, attempts to achieve a dunnage conversion machine capable of producing a void fill product at relatively higher speeds while still maintaining an adequate void fill and/or cushioning capability have not been without problems. Thus, some conversion machines may fail to impart sufficient loft, or an adequate low density, to the sheet material to be converted, resulting in a dunnage product having an undesirably flat, essentially two dimensional, configuration rather than a more desirable three dimensional void fill configuration. In this instance, manual labor is often used to further convert, e.g., crumple, the dunnage product so that it has more desirable void fill capability. Also, the inventors of the present invention have observed that in some dunnage conversion machines the feeding device may engage the sheet stock material at a concentrated portion thereof and/or too abruptly causing sudden increases in the tension of the sheet material which may tear and/or jam the machine, or otherwise deleteriously affect the cushioning characteristics of the dunnage product, or its ability to adequately protect against damage or breakage of the item to be protected.

Thus, it would be desirable to provide a more effective and efficient conversion machine and method suitable for producing a void fill material having adequate void fill capabilities as well as cushioning characteristics (if desired), for example, one which is lightweight with a low density, yet stable, making it suitable for filling the void space around an article to be packaged and for at least minimally protectively cushioning the article from damage during storage or shipment. More particularly, it would be desirable to provide improved speeds at which the dunnage conversion machine operates and consequently its corresponding output rate, while keeping with the objective of providing a void fill product having at least minimal cushioning characteristics.

SUMMARY OF THE INVENTION

The present invention provides a dunnage conversion machine which is particularly suited to production of a void fill dunnage product. According to one general aspect of the invention, opposing grippers including apertures move through a transfer region and laterally capture a crumpled strip of dunnage for advancing the strip of dunnage through the conversion machine. According to another general aspect of the invention, a severing member (such as a blade) is connected to a reciprocating actuator by a motion transmitting assembly that moves the severing member through a full severing cycle upon a single stroke of the actuator in either direction. According to a further general aspect of the invention, a void fill dunnage product includes a three dimensional crumpled strip of dunnage of generally cylindrical shape including at least one ply of sheet material forming multiple substantially longitudinally extending crumpled lobes dispersed in an irregular pattern in cross-section.

The void fill product preferably has the highest possible volume and stability, while using the least possible amount of raw material. This is achieved in accordance with the present invention by producing the noted generally cylindrical product whose stability can yet be further increased by making the same generally curved and/or by permanently deforming the cross-sections of selected spaced portions of the product.

More particularly and according to an aspect of the invention, there is provided a dunnage conversion machine and a method for converting sheet material into a dunnage product, the machine including a forming assembly for shaping the sheet material into a continuous strip of dunnage having a three-dimensional shape, and a pulling assembly positioned downstream from the forming assembly for advancing the sheet material through the forming assembly. The pulling assembly includes at least two grippers movable together through a transfer region in transverse opposition to one another and cooperative to grip therebetween the dunnage strip for advancing the dunnage strip through the transfer region. At least one of the grippers includes an aperture operative to gather and laterally capture therein the dunnage strip as the grippers move through the transfer region.

In an embodiment, an aperture in each gripper tapers in width going from an outer to an inner end of the gripper. The aperture of each gripper preferably is V-shape and may include a rounded bottom. The opposing grippers have contact regions operative to deform opposite sides of the strip of dunnage to capture the strip of dunnage between the opposing grippers.

In an embodiment, the grippers move through the transfer region in longitudinally offset yet paired relation for gripping and advancing the strip of dunnage. The opposing grippers may transversely overlap while advancing the strip of dunnage.

In another embodiment, the grippers are arranged in transversely opposed sets of grippers disposed on opposite transverse sides of the transfer region. The grippers of the opposed sets progressively move towards one another at an upstream end of the transfer region and progressively move away from one another at a downstream end of the transfer region. In an embodiment, the grippers of each set are circumferentially spaced around a common axis and are joined together for rotation about the common axis. The grippers of each set may extend perpendicularly, or at a different angle, relative to the respective common axis.

In yet another embodiment, the pulling assembly includes a set of transfer assemblies having connected thereto the respective sets of grippers. The transfer assemblies are operative to move the grippers of the respective set toward each other at the upstream end of the transfer region to transversely engage the strip of dunnage and away from each other at the downstream end of the transfer region to release the strip of dunnage. The grippers of each set may be movable along a non-circular path in opposite relation to one another and may be operative sequentially, as the grippers move along the non-circular path in opposite relation, to transversely engage the strip of dunnage therebetween on opposite sides thereof for advancing therewith the strip of dunnage. The opposing grippers downstream of the non-circular path preferably gradually release the strip of dunnage. The opposing grippers moving downstream of the non-circular path preferably release the strip of dunnage substantially simultaneously with or after opposing grippers moving along the non-circular path, upstream of the non-circular path, engage the strip of dunnage to advance the same.

An exemplary transfer assembly includes a flexible transfer element and a pair of wheels mounted on respective longitudinally spaced axles, the flexible transfer element having portions thereof trained over the pair of wheels, and wherein the grippers of said respective opposing sets of grippers are affixed to and extend from said respective flexible transfer elements such that at least one gripper from each of said respective opposing sets of grippers are in operative engagement with the strip of dunnage when moving along the non-circular path. The grippers of each set may extend perpendicularly, or at a different angle, relative to the respective flexible transfer element. Also, as is preferred, upon rotation of the pair of wheels, the at least one gripper from each of said respective opposing sets of grippers is longitudinally offset to provide clearance therebetween upon convergence thereof. The flexible transfer elements of the transfer assemblies may comprise articulating chains, flexible belts, or any other means of transferring rotary motion. Preferably, movement of the flexible transfer elements is synchronized.

A forming assembly according to the invention preferably includes a constriction member through which the sheet material is pulled to effect crumpling thereof and forming of the strip of dunnage. The constriction member may be a ring which is, for example, oval and has rounded edges at the upstream end thereof. The constriction member is preferably at an upstream end of the forming assembly. The constriction member constricts and guides the strip of dunnage from a downstream end of the forming assembly to an engagement region between the opposing grippers. The constriction member preferably defines an oval or otherwise round aperture through which the strip of dunnage is compressed circumferentially, the width of the aperture being smaller than the width of the sheet material.

In another embodiment, the grippers are arranged in transversely opposed first and second sets of grippers connected to respective first and second gripper carriages disposed on opposite transverse sides of the transfer region. The first gripper carriage is operative to move longitudinally the first set of grippers along a first non-circular path and the second gripper carriage is operative to move longitudinally the second set of grippers in synchronous relation to the first set of grippers along a second non-circular path. Portions of the first and second paths are juxtaposed to define therebetween the transfer region. At least one gripper of the first set of grippers and at least one gripper of the second set of grippers are operative to transversely engage the strip of dunnage on opposite sides thereof for advancing the strip of dunnage through the transfer region. The transfer region may include an engagement region whereat the first and second non-circular paths converge toward one another, an advancement region whereat the first and second non-circular paths are substantially parallel to one another, and a release region whereat the first and second non-circular paths diverge away from one another.

In an embodiment, the pulling assembly includes first and second transfer elements and first and second series of wheels. The first and second transfer elements are trained over the respective first and second series of wheels and include one or more grippers extending therefrom. The first and second series of wheels rotate in opposite directions and the first and second transfer elements are opposed to define the transfer region therebetween. The grippers of the respective first and second transfer elements are progressively brought into opposing relation to engage and transfer the strip of dunnage through the transfer region. As the first and second series of wheels rotate, the grippers of the respective first and second transfer elements converge toward one another at an upstream end of the dunnage transferring mechanism to engage opposite sides of the strip of dunnage, transfer the strip of dunnage through the transfer region, and then diverge away from one another at a downstream end of the dunnage transferring mechanism to release the strip of dunnage.

According to another aspect of the invention, there is provided a severing assembly for a dunnage conversion machine. The severing assembly severs the dunnage strip into a severed section of dunnage. The machine includes conversion assemblies for converting the sheet material into a continuous strip of dunnage and the severing assembly is positioned relative to the conversion assemblies to sever the continuous strip of dunnage into a severed section of a desired length. The severing assembly includes a movable blade and a reciprocating actuator connected to the movable blade by a motion transmitting assembly that moves the movable blade from a ready-to-sever position to a severed position and back to a ready-to-sever position upon a single stroke of the reciprocating actuator in either direction. The severing assembly may include a stationary blade which coacts with the movable blade as the movable blade moves to the severed position. Preferably, the movable blade coacts with the stationary blade in a scissor-like fashion.

According to another aspect of the invention, there is provided a dunnage conversion machine for converting sheet material, such as paper having at least one ply, into a severed section of dunnage. The dunnage conversion machine includes conversion assemblies for converting the sheet material into a continuous strip of dunnage and a severing assembly positioned relative to the conversion assemblies to sever the continuous strip of dunnage into a severed section of a desired length. The severing assembly includes a movable blade and a reciprocating actuator connected to the movable blade by a motion transmitting assembly that moves the movable blade from a ready-to-sever position to a severed position and back to a ready-to-sever position upon a single stroke of the reciprocating actuator in either direction.

In an embodiment, the dunnage conversion machine further includes an end plate having an upstream side and a downstream side. The conversion assemblies are positioned upstream of the end plate and the end plate has a dunnage outlet opening through which the strip of dunnage emerges. The severing assembly is operative to sever the continuous strip of dunnage after a length of the strip of dunnage has passed through the outlet opening. As is preferred, the movable blade is mounted to the downstream side of the end plate and coupled to the motion-transmitting assembly, the movable blade being movable in a plane parallel to the plane defined by the outlet opening and across the outlet opening as it travels between the ready-to-sever position and the severed position.

In another embodiment, the motion-transmitting assembly includes at least one linkage member pivotally coupled to the movable blade. Preferably, guide plates are mounted on the end plate adjacent the outlet opening and the movable blade is slidably retained within the guide plates whereby, as the reciprocating actuator is moved either in a single forward stroke or a single return stroke, the position of the linkage member will be varied to pivot the movable blade from the ready-to-sever position to the severed position and back to the ready-to-sever position. In another embodiment, one end of the movable blade is pivotally mounted to the end plate at a pivot point, whereby as the reciprocating actuator is moved either in a single forward stroke or a single return stroke, the position of the linkage member will be varied to pivot the movable blade from the ready-to-sever position to the severed position and back to the ready-to-sever position.

In still another embodiment, the severing assembly includes a flared guide member mounted to the upstream side of the end plate for guiding the continuous strip of dunnage into the dunnage outlet opening.

In an embodiment, the conversion assemblies include a forming assembly which shapes the sheet material into the continuous strip of dunnage, a stock supply assembly which supplies the sheet material to the forming assembly, and a pulling assembly which pulls the sheet material from the stock supply assembly and through the forming assembly to form the strip of dunnage.

According to yet another aspect of the invention, there is provided a method of severing a continuous strip of dunnage into a severed section of a desired length, including the steps of using conversion assemblies for converting sheet material, such as paper having at least one ply, into a continuous strip of dunnage, and using a severing assembly positioned relative to the conversion assemblies to sever the continuous strip of dunnage into a severed section of a desired length, wherein the severing assembly includes a movable blade and a reciprocating actuator connected to the movable blade by a motion transmitting assembly. Moving the reciprocating actuator a single stroke causes the motion transmitting assembly to move the movable blade from a ready-to-sever position to a severed position and back to the ready-to-sever position.

In an embodiment, the step of moving the reciprocating actuator includes extending the reciprocating actuator in a forward stroke whereby the movable blade is moved from the ready-to-sever position, to the severed position and back to the ready-to-sever position. In another embodiment, the step of moving the reciprocating actuator includes retracting the reciprocating actuator in a return stroke whereby the movable blade is moved from the ready-to-sever position, to the severed position and back to the ready-to-sever position.

According to another aspect of the invention, there is provided a void fill dunnage product comprising a three dimensional crumpled strip of dunnage round in cross-section and including at least one ply of sheet material having, in cross-section, a crumpled multi-lobed undulating body, with the lobes thereof extending longitudinally and being dispersed in an irregular pattern. The void fill product preferably has the highest possible volume and stability, while using the least possible amount of raw material. As was noted above, this is achieved by the present invention by producing the noted generally cylindrical product whose stability can yet be further increased by making the same generally curved and/or by permanently deforming the cross-sections of selected spaced portions of the product.

In an embodiment, there is at least one transverse crimp on opposite transverse sides of the strip of dunnage. Preferably, the crimps are longitudinally offset from one another.

According to yet another aspect of the invention, there is provided a method of producing a dunnage product, the method comprising the steps of supplying a sheet material having at least one ply and causing inward folding of the lateral edges of the at least one ply of sheet material whereby a three-dimensional crumpled strip of dunnage of round cross-sectional shape is formed. The at least one ply of sheet material forms, in cross-section, a crumpled multi-lobed undulating body, the lobes thereof extending longitudinally and being dispersed in an irregular pattern.

In an embodiment, the strip of dunnage is regularly transversely crimped and/or kinked on opposite sides thereof. Preferably, the crimp on one side is longitudinally offset from the crimp on the opposite side thereof. In an embodiment, the method further includes the step of using a pulling assembly for pulling the strip of dunnage through a constriction member to both narrow the strip of dunnage via three dimensional crumpling thereof and to guide the strip of dunnage to the pulling assembly. The constriction member ensures a substantially jam-free flow of the strip of dunnage through the pulling assembly.

The foregoing and other features of the invention are hereinafter more fully described and particularly pointed out in the claims, the following description and the annexed drawings setting forth in detail illustrative embodiments of the invention, such being indicative, however, of but one or a few of the various ways in which the principles of the invention may be employed.

DETAILED DESCRIPTION

Figure 1:
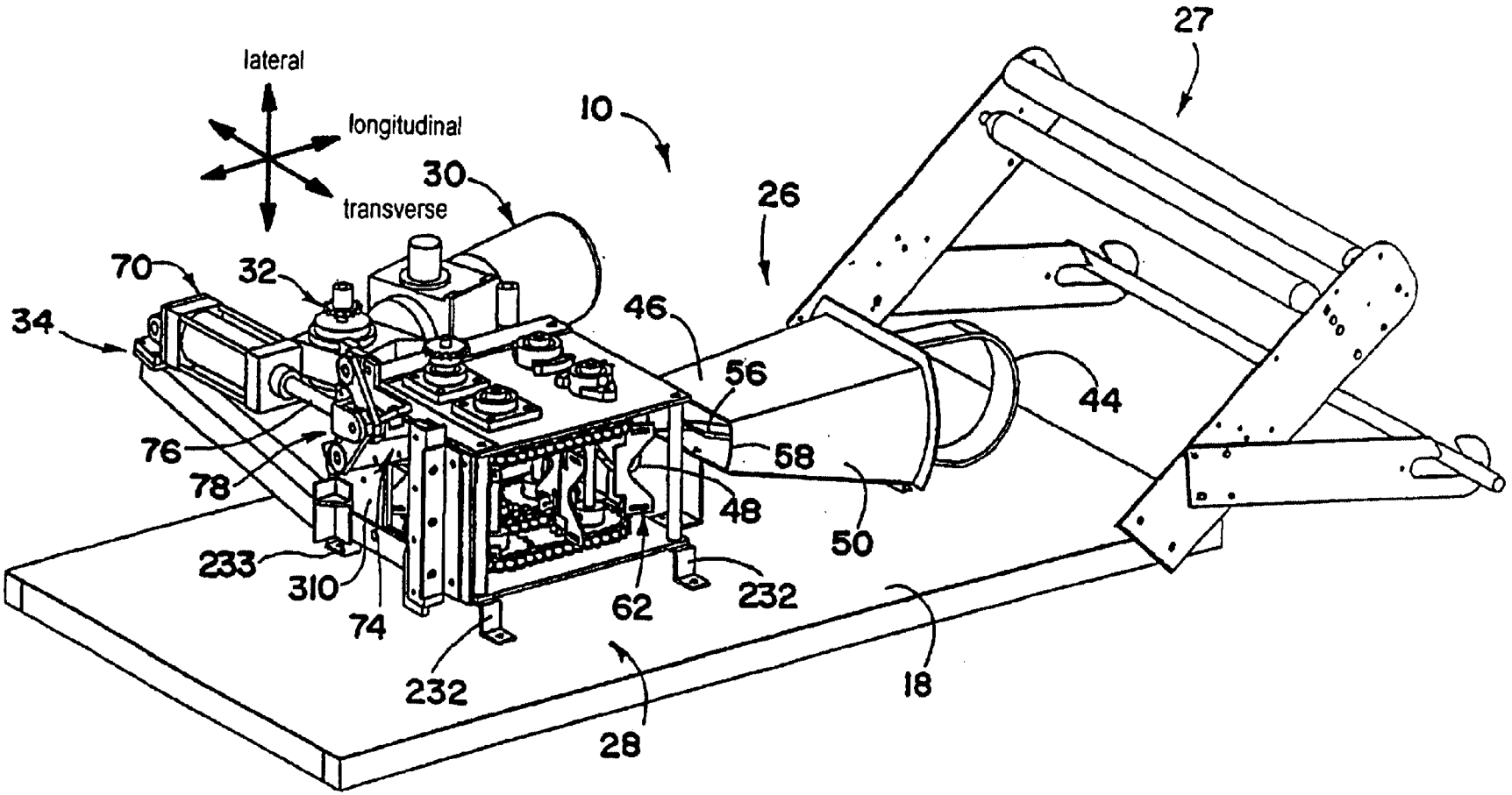
FIG. 1 is a perspective view of a dunnage conversion machine in accordance with the present invention with a housing thereof removed to permit viewing of internal components of the machine.
Figure 2:
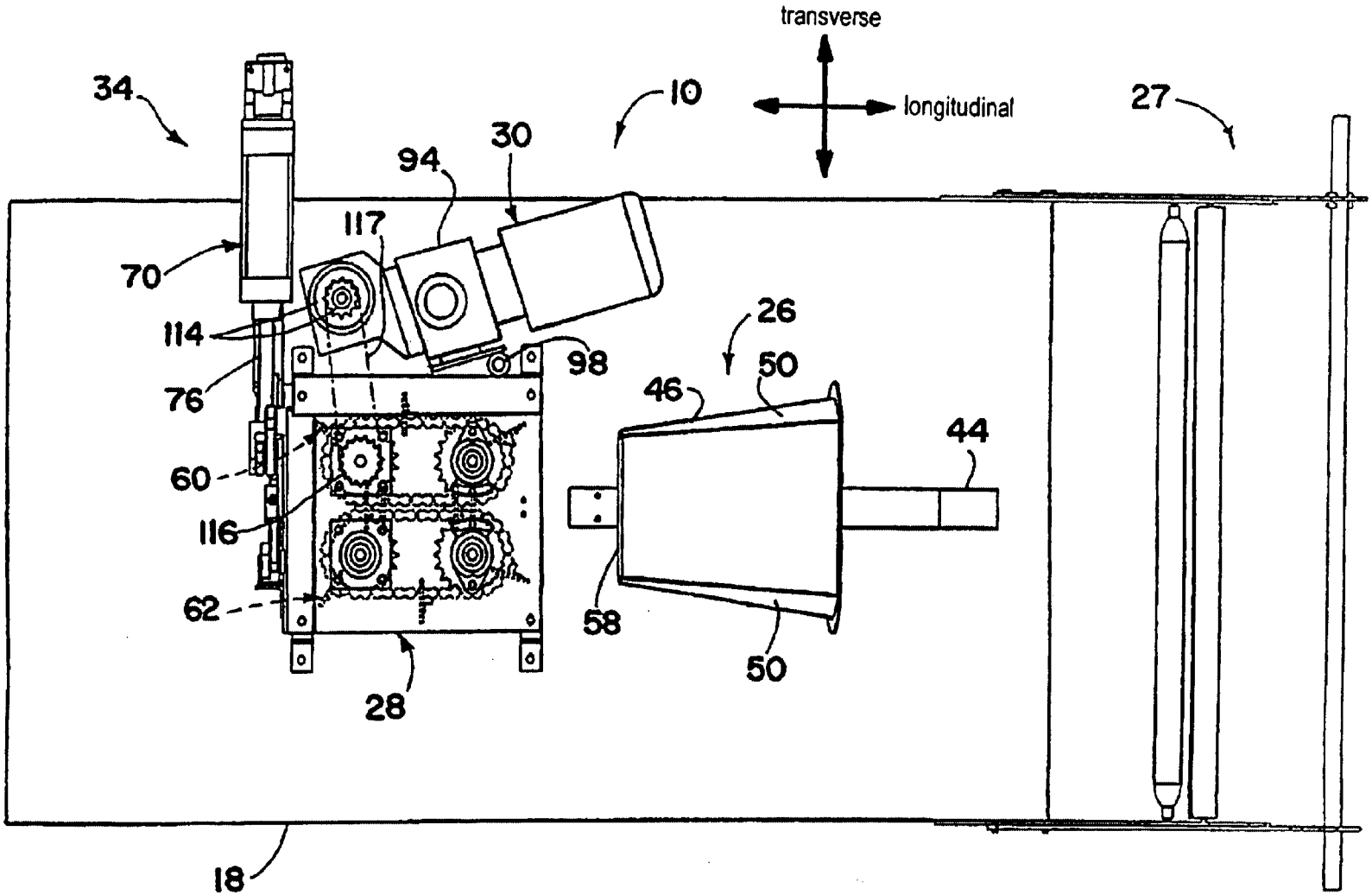
FIG. 2 is a top plan view of the dunnage conversion machine of FIG. 1.
Figure 3:
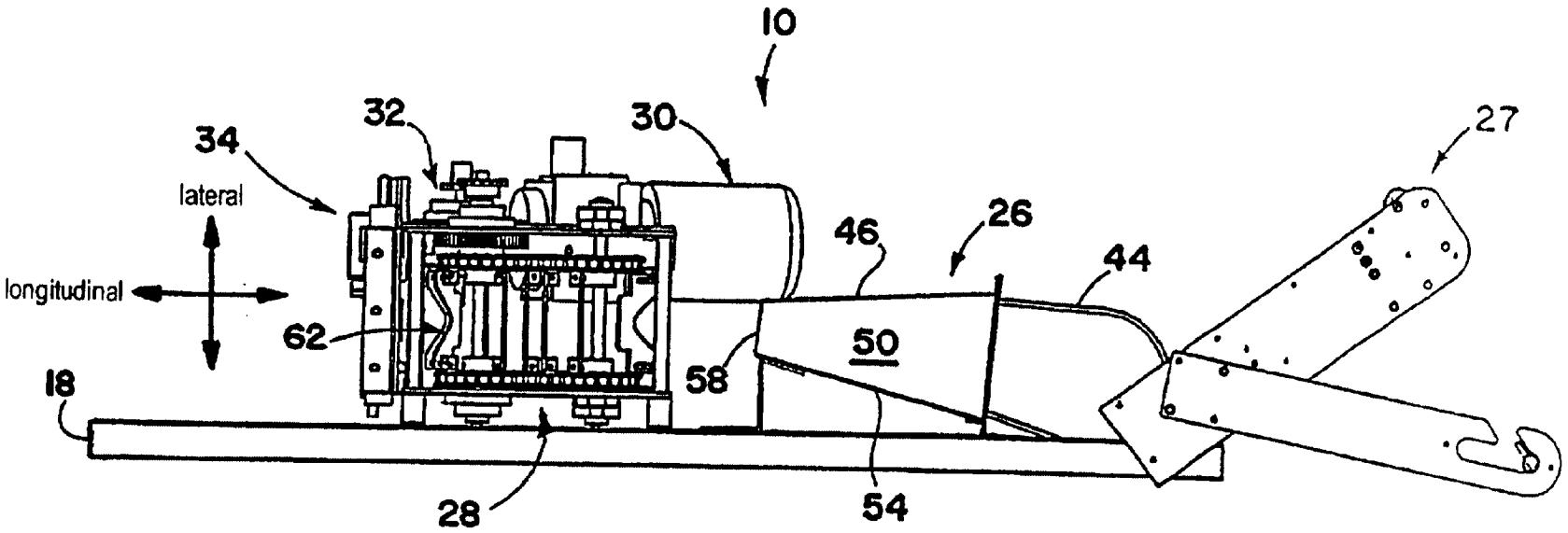
FIG. 3 is a side elevational view of the dunnage conversion machine of FIG. 1.

Referring now to the drawings in detail and initially to FIGS. 1 to 3, a dunnage conversion machine in accordance with the present invention is designated generally by reference number 10. The dunnage conversion machine 10 converts a sheet-like stock material, such as one or more layers of recyclable and reusable Kraft paper, into a strip of dunnage including, for example, a relatively narrow three dimensional strip or rope of a generally cylindrical shape. The dunnage product is used as an environmentally responsible protective packaging material typically used as void fill or cushioning during shipping.

The machine's frame includes a base plate 18 which is generally rectangular in shape and, in the illustrated orientation, extends from its upstream end to its downstream end in a generally horizontal plane. (The terms "upstream" and "downstream" in this context are characteristic of the direction of flow of the sheet material through the machine.) While not specifically shown/numbered in the drawings, the frame preferably also includes a housing or cover, which is removed to permit viewing of the internal components of the machine 10.

The dunnage conversion machine 10 includes a forming assembly 26, a stock supply assembly 27, of any desired type, for supplying sheet material to the forming assembly 26, and a pulling assembly 28 powered (energized) by a motor 30, for example a rotary electric motor. Downstream of the pulling assembly, there is provided a severing assembly 34 for severing a continuous strip of dunnage formed by the forming assembly 26 into a desired length pad. The stock supply assembly 27, the forming assembly 26, the pulling assembly 28 and the severing assembly 34 are mounted to the base plate 18 and/or in the housing of the dunnage conversion machine 10. The operation of the dunnage conversion machine 10 may be controlled by a known controller (not shown).

In operation of the machine 10, the stock supply assembly 27 supplies sheet material to the forming assembly 26. The illustrated exemplary forming assembly 26 includes a forming member 44, such as a forming frame, a converging shaping chute 46, and a constriction member 48. The shaping chute 46 includes longitudinally extending, transversely converging side walls 50 which preferably are curved or arcuate in transverse cross-section. As the sheet stock material is passed through the shaping chute 46, the side edges thereof are folded or rolled inwardly towards one another so that the inwardly folded edges form multiple substantially longitudinally extending resilient crumpled portions of sheet material as they emerge from the exit end of the shaping chute, thus preforming and streamlining the sheet material.

The forming member 44 coacts with the shaping chute 46 to ensure proper shaping and forming of the paper (or other suitable sheet material), the forming member 44 being operative to guide the central portion of the sheet material along a bottom wall 54 of the shaping chute 46 for controlled inward folding or rolling of the lateral edge portions of the sheet material. The forming member 44 projects rearwardly (upstream) of the entry end of the shaping chute 46 for proper guiding of the sheet material into the shaping chute 46. The forming member 44 also extends into the shaping chute 46 with its forwardmost end 56 (FIG. 1) disposed relatively close to the underlying bottom wall 54 of the shaping chute 46 adjacent the exit end 58 of the shaping chute 46, as shown.

As is further described below, the constriction member 48 further forms or shapes the sheet material, and may also be called a gathering member. The constriction member 48 may alternatively be used as the forming assembly 26 without the forming member 44 or shaping chute 46. The constriction member 48 performs the additional function of directing the formed strip of dunnage into the pulling assembly 28. Other types of forming assemblies may be employed, such as those disclosed in commonly owned U.S. Pat. Nos. 5,947,886 and 5,891,009, which are hereby incorporated herein by reference.

The pulling assembly 28 is located downstream of the forming assembly 26 and, in accordance with the present invention, includes a first set of translating grippers 60 and a second set of cooperating and opposing translating grippers 62 which, as described in greater detail below, together perform at least one and preferably two functions in the operation of the dunnage conversion machine 10. One function is a feeding function whereby the opposing sets of translating grippers 60 and 62 progressively transversely engage the strip of dunnage on opposite transverse sides thereof to pull the dunnage strip through the forming assembly 26 and in turn the sheet material from the stock supply assembly 27. It will be appreciated that this progressive engagement improves the manner by which the strip of dunnage is gripped and enables the rate at which the strip of dunnage is produced to be increased.

The second function preferably performed by the pulling assembly 28 is a connecting function whereby the opposing sets of translating grippers 60 and 62 deform the strip of dunnage on opposite sides thereof to form a connected strip of dunnage. Of course, other mechanisms may be employed to "connect" the dunnage strip, i.e., to operate on the dunnage strip in such a manner that it will retain its void fill and/or cushioning properties as opposed to reverting to the original flat form of the sheet material. For example, known connecting mechanisms include mechanisms that crease the sheet material to enable the sheet material to hold its three-dimensional shape.

In the exemplary embodiment, the continuous strip of dunnage travels downstream from the pulling assembly 28 to the severing assembly 34 which severs, as by cutting or tearing, the strip of dunnage into a section of a desired length. In accordance with the present invention, the severing assembly 34 includes a reciprocating actuator in the form of a push-pull mechanism 70, and a movable blade assembly 74. A reciprocating member 76 of the reciprocating actuator 70 is operatively connected to the movable blade assembly 74 via a motion-transmitting assembly 78. As is described in greater detail below relative to FIGS. 12–15, a single forward or return stroke of the reciprocating member 76 causes the movable blade assembly 74 of the severing assembly 34 to move from a ready-to-sever, or open, position to a severed, or closed, position whereby the dunnage strip is severed, and then back to a ready-to-sever position. This enables the severing assembly 34 to operate in a continuous manner, or "on the fly", since after a severance is made the movable blade assembly 74 is returned to the open position, readying the movable blade assembly 74 for severing the next succeeding strip of dunnage.

Thus, it will be appreciated that the present invention provides certain improvements in the dunnage conversion machine art, the hereinafter improvements being desirable, for example, in applications requiring converting material at improved speeds without compromising the integrity of the void fill and/or cushioning characteristics of the resultant dunnage product. More particularly, the present invention discloses novel opposing sets of translating grippers 60 and 62 enabling gradual transverse engagement and progressive advancement of the strip of dunnage across the full width of the strip so as to prevent, or at least reduce the likelihood of, the afore-described abrupt tearing sometimes experienced by previously known conversion machines. In addition, the on the fly severing provided by the severing assembly 34 of the present invention enables rapid continuous severing of the strip of dunnage as it emerges from the pulling assembly 28.

Referring then to FIGS. 1–3, and more particularly to FIGS. 4–11, the pulling assembly 28 includes a pair of transfer assemblies 110 and 112 disposed in side-by-side, or juxtaposed, relationship to define therebetween a dunnage transfer region 113 (FIGS. 8, 9 and 11) through which the strip of dunnage from the forming assembly 26 passes. The transfer assemblies 110 and 112 are driven by the motor 30. More particularly, the motor 30 and transfer assembly 110 include respective rotatable wheels 114 and 116 over which a flexible drive element 117 (FIG. 2) is trained to transfer movement from the motor 30 to the transfer assembly 110.

The flexible drive element 117 may comprise an articulating chain, as shown, a flexible belt or other means of transferring rotary motion. The rotatable wheels 114 and 116 may comprise sprockets for use with the articulating chains, as shown, pulleys for use with flexible belts, or any other suitable means for carrying the flexible drive element 117. The rotatable electric motor 30 preferably is a variable speed motor and may include a speed reducer 94 (FIG. 2) for controlling and/or adjusting the speed thereof and that of the transfer assembly 110 through the flexible drive element 117.

The transfer assembly 110, in turn, includes a drive gear 120 which coacts with a driven gear 122 of the transfer assembly 120 to drive the transfer assembly 120 in a direction opposite that of the transfer assembly 110. The coacting gears 120 and 122 are the same size and, consequently, the speed at which the transfer assemblies 110 and 112 operate is the same.

The transfer assemblies 110 and 112 further include respective upper flexible transfer elements 130 and 132 and respective lower flexible transfer elements 140 and 142 which are trained over respective upper pairs of rotatable wheels 160, 161 and 162, 163 and lower pairs of rotatable wheels 170, 171 and 172, 173 mounted on respective longitudinally spaced axles 180, 181 and 182, 183. The flexible transfer elements 130, 132 and 140, 142 transfer rotational movement from the gears 120 and 122, which are connected to upper ends of the axles 180 and 182, respectively, into synchronous rotational movement in the respective pairs of axles 180, 181 and 182, 183 and, accordingly, synchronous movement in the respective transfer assemblies 110 and 120. The juxtaposed arrangement and synchronous movement of the transfer assemblies 110 and 120 translates into the flexible transfer element 130 moving in unison with and in opposing relation to the flexible transfer element 132 and, similarly, the flexible transfer element 140 moving in unison with and in opposing relation to the flexible transfer element 142.

As with the flexible drive element 117, the flexible transfer elements 130, 132 and 140, 142 may comprise articulating chains, as shown, flexible belts or any other means of transferring motion between the respective axles 180, 181 and 182, 183. The axles 180, 181 and 182, 183 are disposed relatively parallel to each other and transverse to the path of travel of the strip of dunnage. The rotatable wheels 160, 161, 162, 163, and 170, 171, 172, 173 may comprise sprockets for use with the articulating chains, as shown, pulleys for use with flexible belts, or any other type of routing members for carrying the respective flexible transfer elements 130, 132 and 140, 142.

Figure 4:
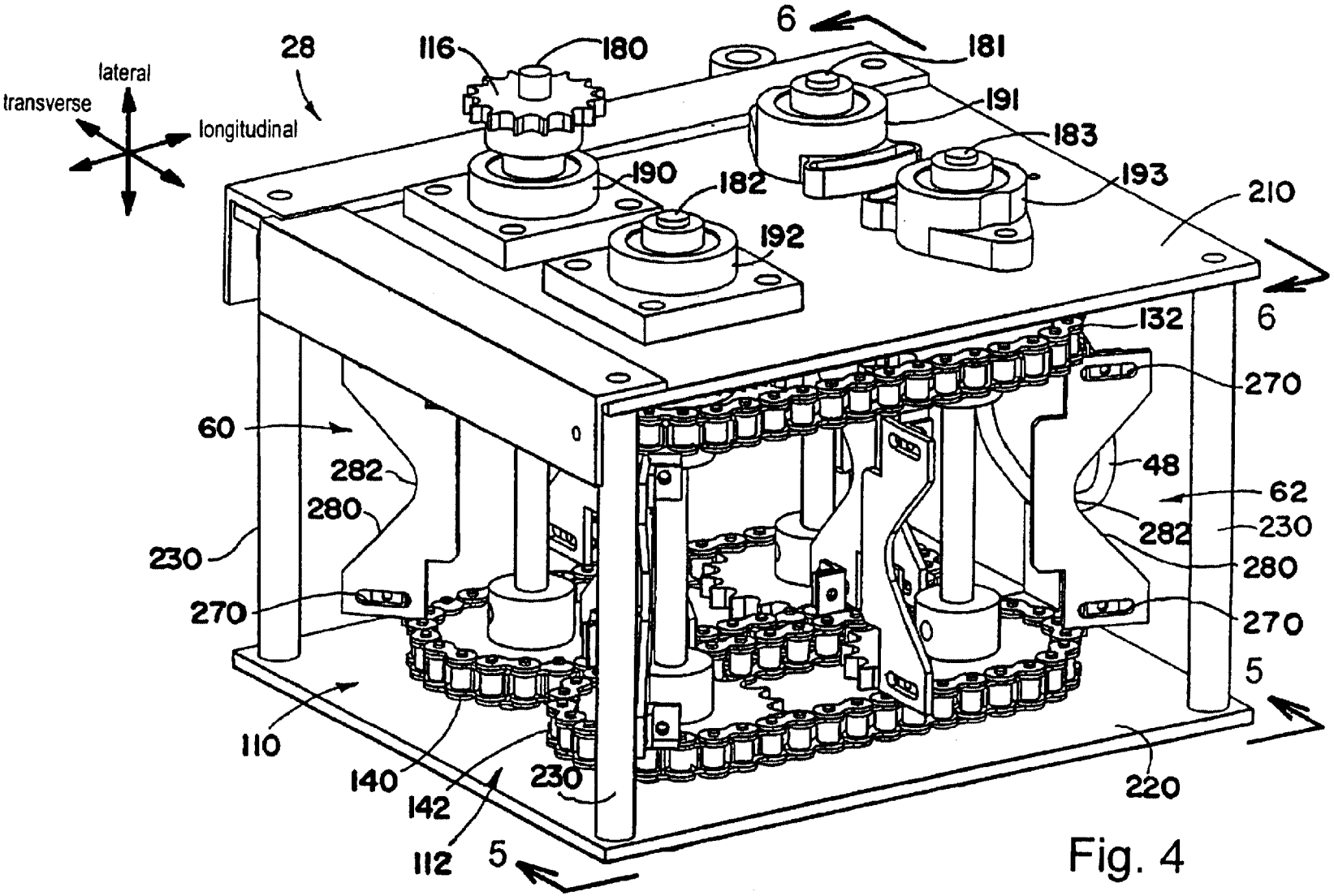
FIG. 4 is an enlarged perspective view of a pulling mechanism of the dunnage conversion machine of FIG. 1.
Figure 5:
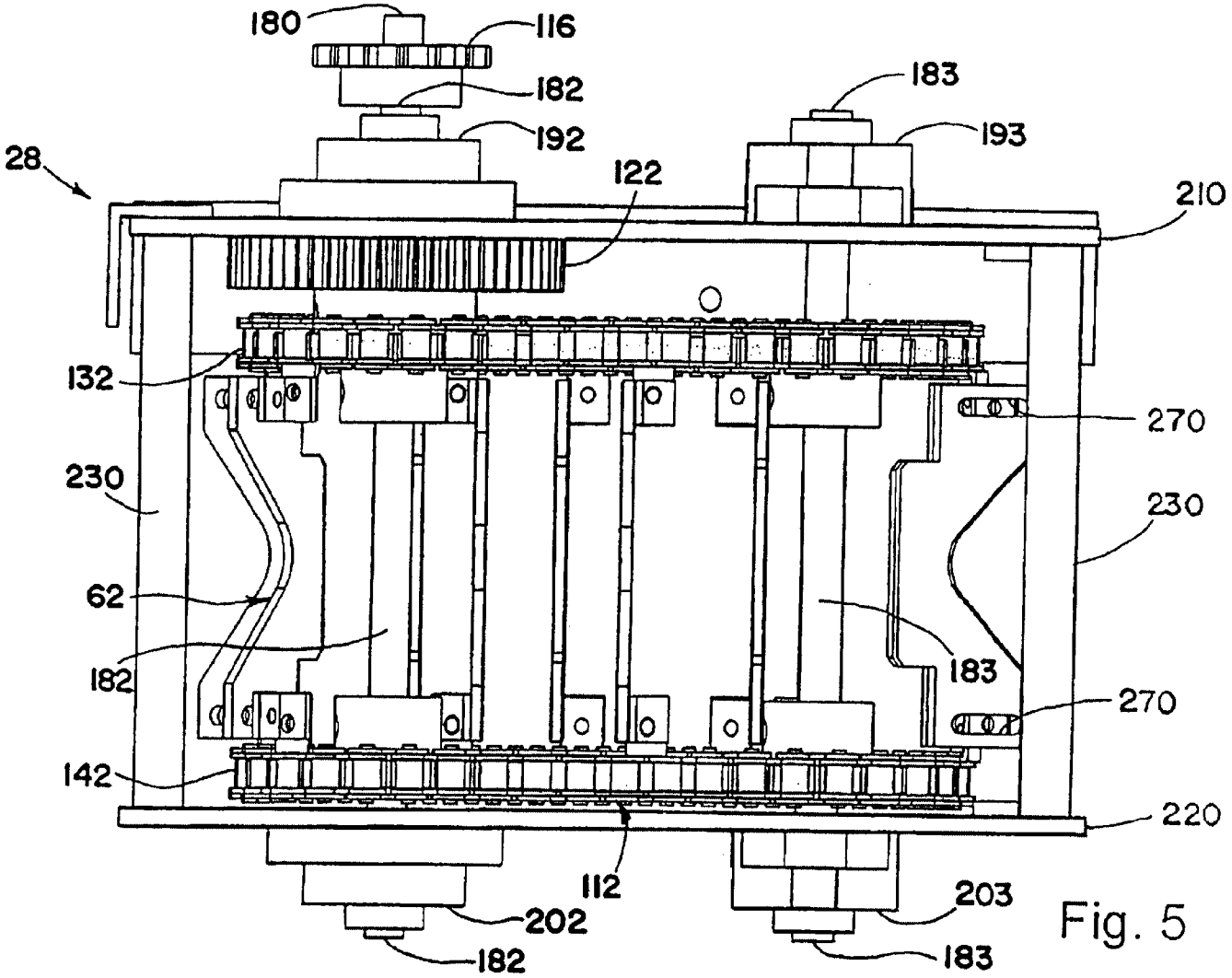
FIG. 5 is a side elevational view of the pulling mechanism of FIG. 4 as seen along line 5—5 in FIG. 4.
Figure 6:
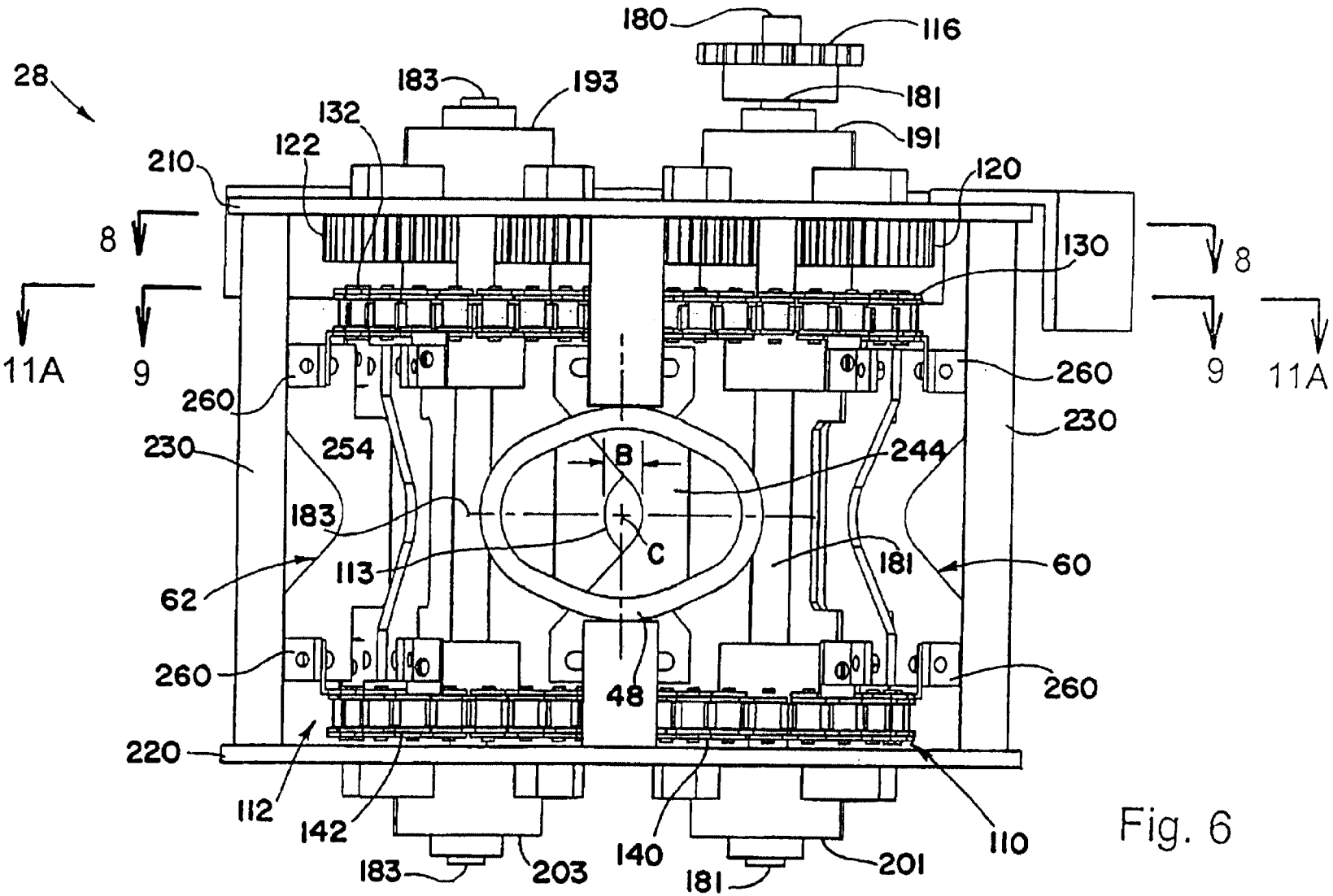
FIG. 6 is an end elevational view of the pulling mechanism of FIG. 4 as seen along line 6—6 in FIG. 4.
Figure 7:
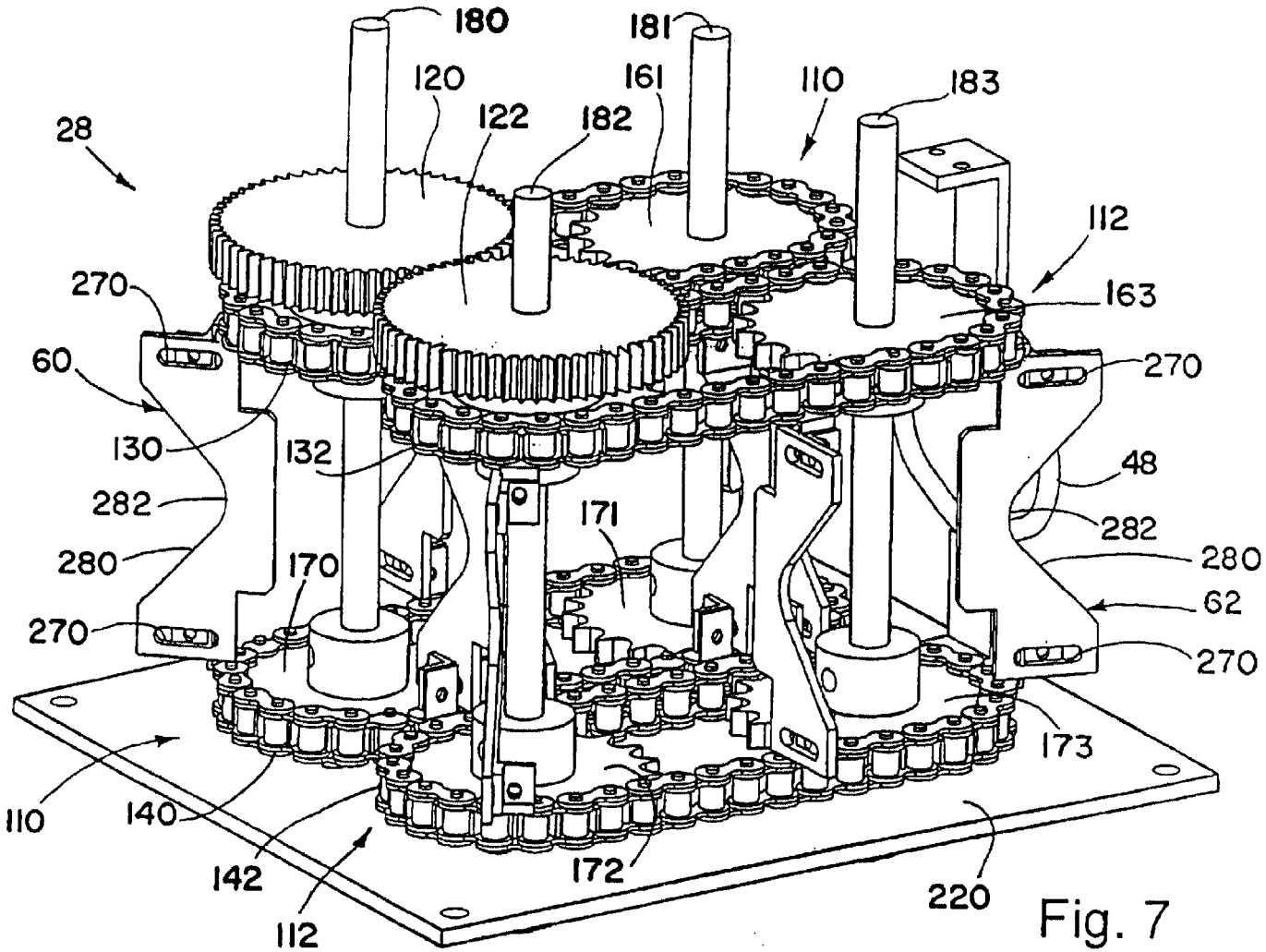
FIG. 7 is a perspective view of the pulling mechanism of FIG. 4 with a top support panel thereof removed to permit viewing of a gear train of the pulling mechanism.

As is best shown in FIGS. 4–6, each axle or shaft 180, 181 and 182, 183 is rotatably mounted at its opposite ends in respective upper bearings 190, 191 and 192, 193 and respective lower bearings 200, 201 and 202, 203 which are held, respectively, in an upper support panel 210 and a lower support panel 220. The upper support panel 210 and lower support panel 220 are spaced apart by four vertical support members 230 at the respective corners thereof. The lower support panel 220 is mounted on four S-shaped stand off brackets 232 (FIG. 1) to the base plate 18 of the dunnage conversion machine 10. The stand-off brackets 232 provide clearance underneath the lower support panel 220 into which the lower bearings 200, 201, 202 and 203 extend.

Figure 8:
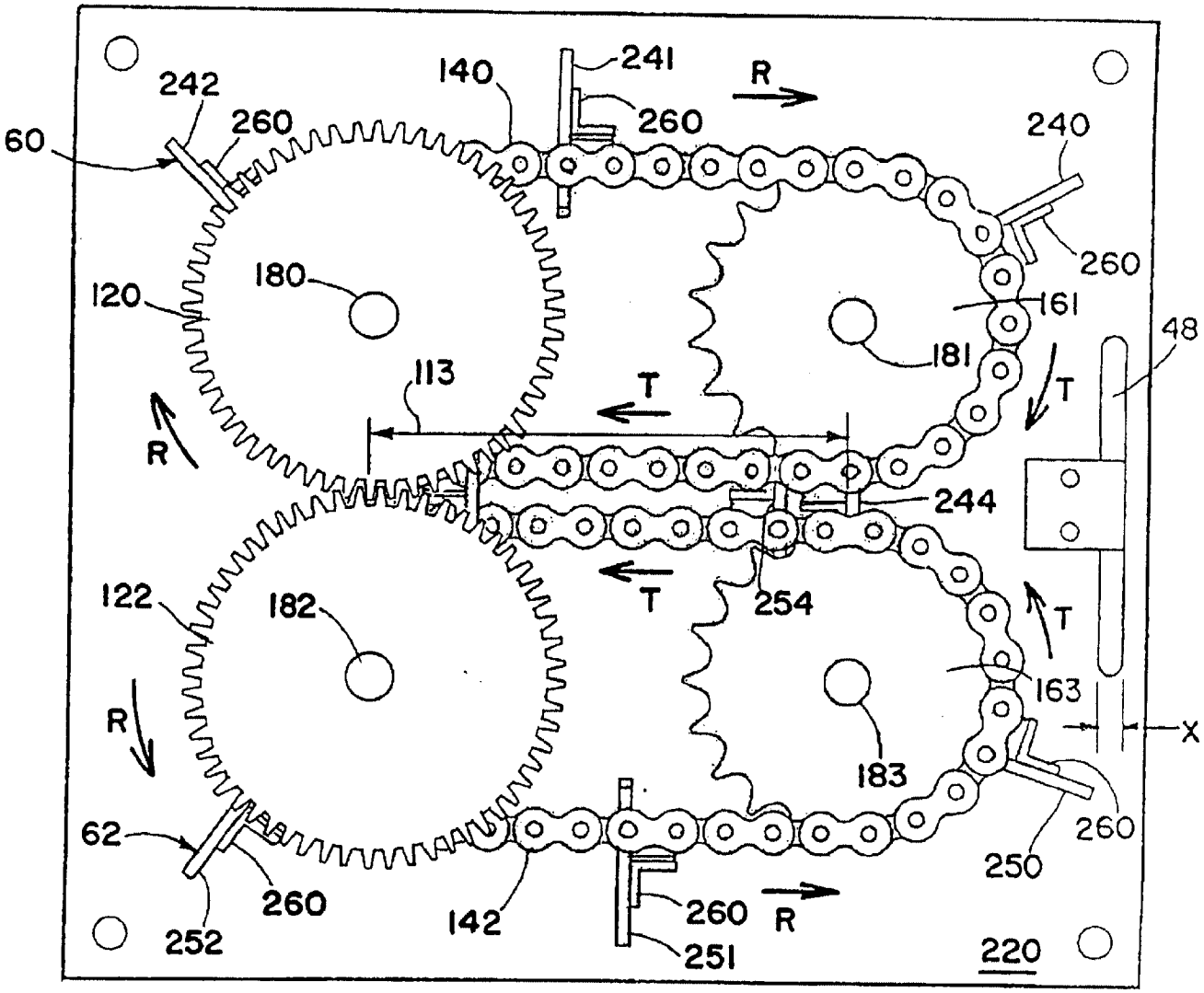
FIG. 8 is a top plan view of the pulling mechanism of FIG. 4 as seen along the line 8—8 in FIG. 6.
Figure 9:
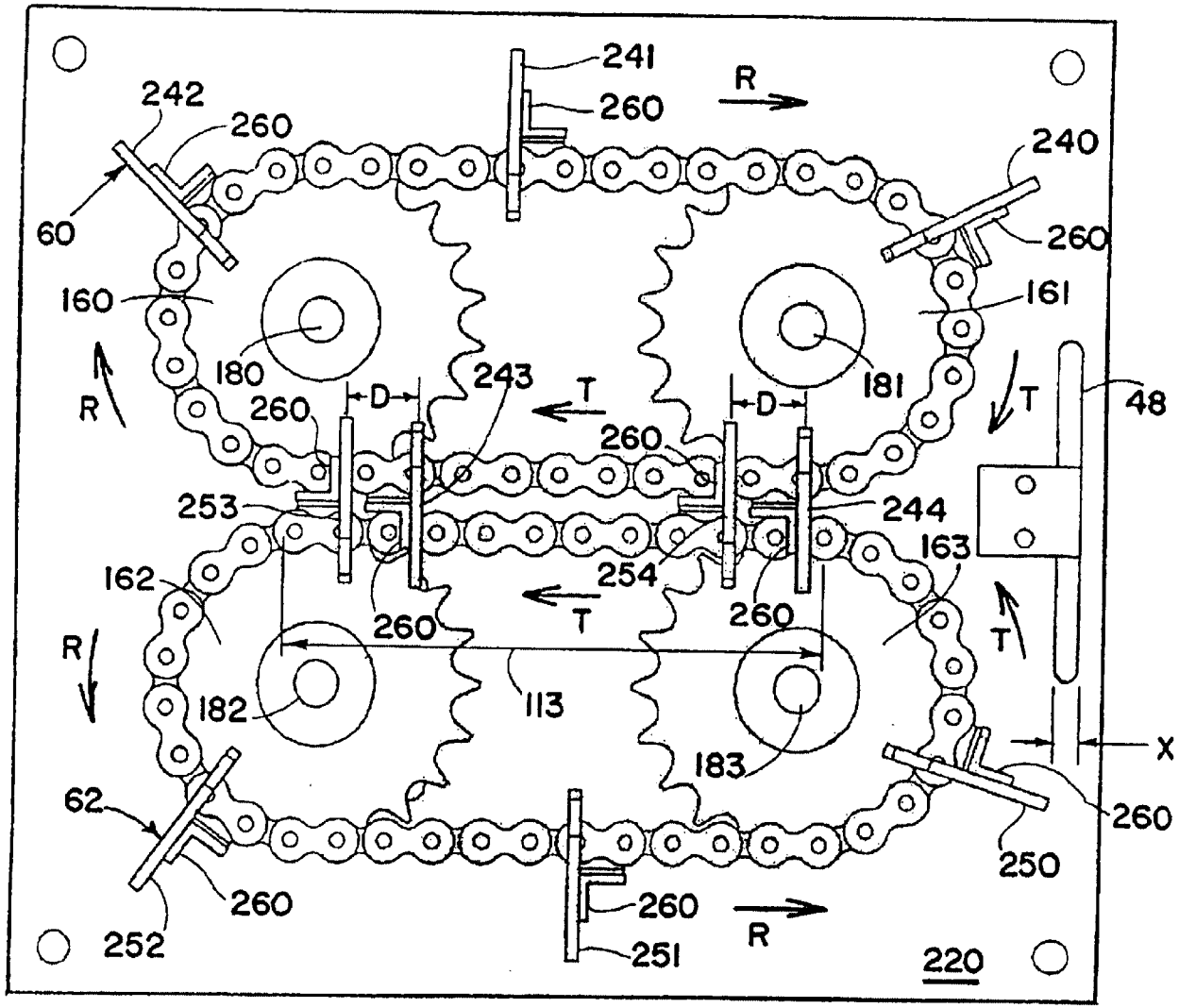
FIG. 9 is a top plan view of the pulling mechanism of FIG. 4 as seen along the line 9—9 in FIG. 6.
Figure 10:
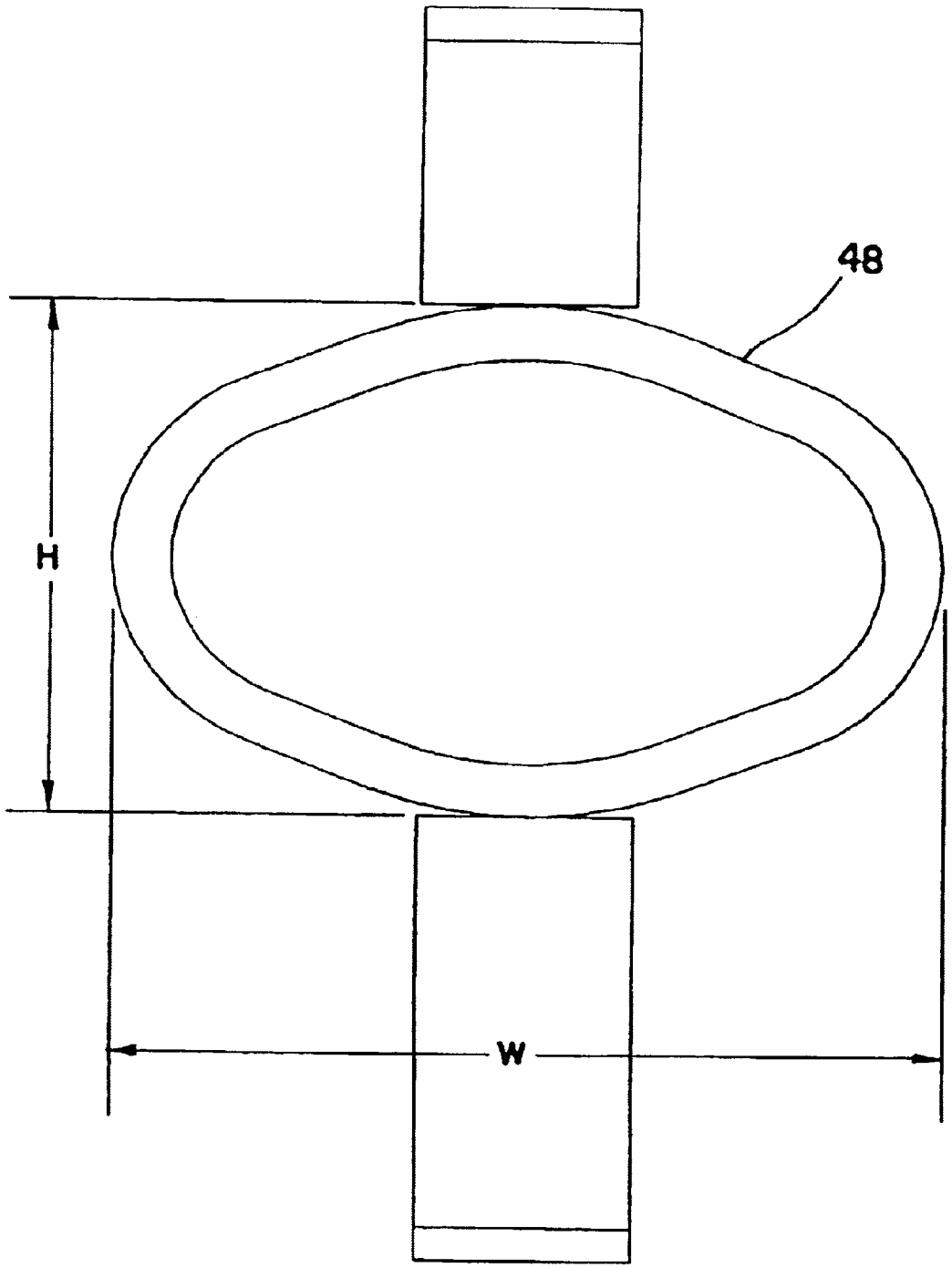
FIG. 10 is an enlarged end view of a constriction member of the forming assembly.

Referring now to FIGS. 8, 9 and 11, the illustrated exemplary opposing sets of translating grippers 60 and 62 respectively include a first set of uniformly spaced apart grippers 240, 241, 242, 243 and 244 and a second opposing set of uniformly spaced apart grippers 250, 251, 252, 253 and 254. Of course, the quantity and/or type of grippers employed may be other than that shown in the several figures depending on, for example, the length of the flexible transfer elements, the desired frequency at which the strip of dunnage is engaged by the grippers, the geometric configuration of the grippers, or the type of engagement desired by the grippers (e.g., whether it is desired to have the strip of dunnage connected by the grippers).

Each gripper 240, 241, 242, 243, 244 and 250, 251, 252, 253, 254 has opposite ends thereof affixed to the respective upper and lower flexible transfer elements 130, 132 and 140, 142, preferably in perpendicular relation thereto via, for example, L-shaped brackets 260 (FIGS. 8 and 9). In this way, the flexible transfer elements 130, 132 and 140, 142 function as gripper carriages (carriers) to carry the grippers 240, 241, 242, 243, 244 and 250, 251, 252, 253, 254 along their respective paths of travel while providing stability at the opposite ends, i.e., the upper and lower ends, of the grippers 240, 241, 242, 243, 244 and 250, 251, 252, 253, 254. As is most clearly shown in FIGS. 4, 5 and 7, each gripper 240, 241, 242, 243, 244, 250, 251, 252, 253, 254 includes at opposite ends thereof slots 270 enabling the grippers to be adjusted inwardly and outwardly relative to the travel paths of the flexible transfer elements 130, 132 and 140, 142.

Referring to FIGS. 8 and 9, the flexible transfer elements 130, 132 and 140, 142 continuously move, or carry, the respective grippers 240, 241, 242, 243, 244 and 250, 251, 252, 253, 254 along transfer flight paths and return flight paths indicated generally by arrows T and R, respectively. The transfer flight paths T are, as their nomenclature suggests, the paths whereat the opposing sets of translating grippers 60 and 62 transfer the strip of dunnage from an upstream end of the pulling assembly 28 to a downstream end of the pulling assembly 28. To this end, the transfer flight paths T together form the above mentioned dunnage transfer region 113 through which the strip of dunnage is gradually transversely engaged, advanced and released. The transfer flight paths T are substantially non-circular paths, i.e., substantially linear, as is the dunnage transfer region 113 formed thereby.

The return flight paths R, which are also substantially non-circular paths, are the paths whereat the opposing sets of translating grippers 60 and 62 return from the downstream end of the pulling assembly 28 to the upstream end of the pulling assembly 28; i.e., back to the upstream end of the dunnage transfer region 113 to gradually transverse engage the next or succeeding strip of dunnage.

It will be appreciated that the gradual transverse engagement of the strip of dunnage is facilitated by the grippers 240, 241, 242, 243, 244 of the first set of grippers 60 gradually approaching the grippers 250, 251, 252, 253, 254 of the second set of grippers 62 at the upstream end of the dunnage transfer region 113 as the flexible transfer elements 130, 132 and 140, 142 gradually move from the return flight paths R to the transfer flight paths T. Of course, the point of transverse engagement will vary depending on, for example, the extent of the respective grippers relative to the flexible transfer elements to which they are affixed. Thus, for example, relatively longer grippers may engage the strip of dunnage sooner and/or further upstream than relatively shorter grippers. In this regard, the size and/or dimensions of the dunnage transfer region 113, and more particularly the transfer flight paths T forming the dunnage transfer region 113, will likewise depend on such factors as the extent of the grippers.

The gradual transverse engagement may also be facilitated by the geometric configuration of the grippers 240, 241, 242, 243, 244 and 250, 251, 252, 253, 254. As is most clearly shown in FIGS. 4 and 7 of the exemplary pulling assembly 28, each gripper 240, 241, 242, 243, 244 and 250, 251, 252, 253, 254 has a somewhat V-shaped opening or contact region 280 with a rounded base portion or contact region 282. As the grippers 240, 241, 242, 243, 244 and 250, 251, 252, 253, 254 converge towards each other at the upstream end of the pulling assembly 28 the opposing grippers 240, 241, 242, 243, 244 and 250, 251, 252, 253, 254 gradually transversely engage the strip of dunnage on opposite sides thereof at least partially in contact with and within the contact regions 280 and 282.

More particularly, the V-shaped openings or contact regions 280 and 282 of the opposing grippers 240, 241, 242, 243, 244 and 250, 251, 252, 253, 254 together form a gap B (FIG. 6) therebetween which gradually becomes narrower as the grippers 240, 241, 242, 243, 244 and 250, 251, 252, 253, 254 progressively move from the aforementioned return flight paths R to the transfer flight paths T. The narrowing of the gap B between the grippers 240, 241, 242, 243, 244 and 250, 251, 252, 253, 254 eventually reaches a minimal gap size (FIG. 6) by which the strip of dunnage is fully transversely engaged, or locked, by the opposing grippers 240, 241, 242, 243, 244 and 250, 251, 252, 253, 254.

In other words, the V-shaped contact regions 280 and rounded base portions or contact regions 282 of the opposing grippers 240, 241, 242, 243, 244 and 250, 251, 252, 253, 254 "close in" on each other to grip or lock the strip of dunnage therebetween. The grippers 240, 241, 242, 243, 244 and 250, 251, 252, 253, 254 are then translated further downstream by the respective flexible transfer elements 130, 132 and 140, 142 through the pulling assembly 28. Of course, other geometric configurations may be used to facilitate the afore-described gradual transverse engagement of the strip of dunnage and such alternative configurations are contemplated as falling within the scope of the presently claimed invention. Thus, for example, the openings 280 may be semicircular or semi-oval in shape to achieve the transverse engagement.

It is noted that, in the illustrated exemplary embodiment, the grippers 240, 241, 242, 243, 244 of one transfer assembly 110 are longitudinally offset by a gap D (FIG. 9) in relation to the grippers 250, 251, 252, 253, 254 of the other opposing transfer assembly 112. This offsetting, or staggering, of the grippers 240, 241, 242, 243, 244 relative to the respective grippers 250, 251, 252, 253, 254 enables the grippers 240, 241, 242, 243, 244 and 250, 251, 252, 253, 254 to converge at the upstream end of the pulling assembly 28 along non-interfering travel paths; i.e., without the grippers 240, 241, 242, 243, 244 and 250, 251, 252, 253, 254 colliding or otherwise interfering with each others' respective paths of travel. In this regard, whether the grippers can be longitudinally offset will depend on the size and dimensions of the grippers, as well as their adjustability. For example, the perpendicular extension of the grippers relative to the flexible transfer elements may be adapted to be shorter, either by design or by adjusting the grippers via their respective slots 270, so that opposing grippers are sufficiently spaced apart to prevent interfering travel paths at the upstream end of the pulling assembly 28.

Once the opposing grippers 240, 241, 242, 243, 244 and 250, 251, 252, 253, 254 have transversely engaged the strip of dunnage, the opposing grippers 240, 241, 242, 243, 244 and 250, 251, 252, 253, 254 maintain a grip on the strip of dunnage for the duration of their travel through the dunnage transfer region 113, which is generally about the length of the longitudinal distance between the parallel and spaced apart axles; i.e., from axle 181 to 180, or from 183 to 182. In the exemplary pulling assembly 28, during passage through the transfer region 113 the strip of dunnage is crimped and/or deformed on opposite sides thereof by the opposing grippers 240, 241, 242, 243, 244 and 250, 251, 252, 253, 254 thereby causing overlapping portions of the sheet material to connect. Because the exemplary grippers 240, 241, 242, 243, 244 and 250, 251, 252, 253, 254 are in relatively offset relation the crimping and/or kinking on one side of the strip of dunnage is actually spaced apart by the gap D from the crimping and/or kinking on the other or opposite side thereof.

As is seen in FIG. 6, in the dunnage transfer region 113 when the shown opposing grippers 244 and 254 transversely engage the strip of dunnage, the gripper 244 transversely overlaps the gripper 254. The greater the amount of overlap the smaller the gap B between opposing grippers and, consequently, the greater the crimping and/or deforming on opposite transverse sides of the strip of dunnage.

At the downstream end of the pulling assembly 28, and more particularly the downstream end of the dunnage transfer region 113, the opposing sets of translating grippers 60 and 62 gradually diverge away from each other to release the strip of dunnage. In this regard, the grippers 240, 241, 242, 243, 244 and 250, 251, 252, 253, 254 are moved from their transfer flight paths T to their return flight paths R.

As was alluded to above, the pulling assembly 28 may function as a feeding assembly and/or a connecting assembly. The grippers 240, 241, 242, 243, 244 and 250, 251, 252, 253, 254 of the illustrated exemplary pulling assembly 28 causes the sheet material to be pulled (i.e., feeds the sheet material) through the forming assembly 26 and also progressively crimp and/or kink (i.e., connect) the strip of dunnage at regular intervals as it passes through the pulling assembly 28.

Other means of connecting may also be employed, as alluded to above. For example, the grippers may include tangs whereby as they transversely engage and advance material through the pulling assembly, the grippers also pierce the strip of dunnage and interconnect the overlapping layers of sheet material thereof. Alternatively, the grippers may not include any form of connecting but rather only pull the strip of dunnage through the forming assembly and advance the strip of dunnage downstream of the pulling assembly. For example, the grippers may include enhanced friction members on the edge portions thereof (e.g. rubber) enabling the grippers to transversely engage the outer surface of the strip of dunnage to advance the strip of dunnage through the pulling assembly. In such case, the crimper or deformer (i.e., the connecting assembly) may be disposed downstream of the pulling assembly and the pulling assembly may feed the strip of dunnage from the feeding assembly to the connecting assembly. The connecting assembly may then take the form of, for example, a set of gears or pinchers which pierce the sheet material so that one section interconnects with another section of the sheet material to thereby prevent the unfolding thereof.

Referring now to FIGS. 1, 6 and 8–11A there is shown attached to the lower support panel 220 of the pulling assembly 28 the oval or round shaped constriction or post-forming member 48 which preferably has a width dimension W larger than its height dimension H (FIG. 10), and an axial length dimension X substantially less than the width or height dimension. In the illustrated exemplary embodiment, the oval shaped constriction member 48 forms part of the forming assembly 26 to further form or shape the strip of dunnage. The constriction member 48 effects three dimensional crumpling of the sheet material as it is squeezed therethrough, as by radially and/or axially crumpling the sheet material, and ensures a substantially jam-free flow of the sheet material through the subsequent downstream pulling assembly 28. The constriction member 48 also guides the sheet material from the guide chute 46 and former 44 into the dunnage transfer region 113 of the pulling assembly 28.

Although the shape of the exemplary constriction member 48 is oval or round shaped, other shapes are contemplated as falling within the scope of the presently claimed invention. Thus, for example, the shape of the constriction member 48 may be circular, or the constriction member 48 may comprise two half or semi-circular or semi-oval bars or members. The present invention also contemplates use of the constriction member 48 without the afore-described forming member 44 and shaping chute 46 so that, for example, the sheet material is advanced from the stock supply assembly 27 directly to the constriction member 48.

As shown in FIG. 6, the center point C of the oval shaped constriction member 48 lies in the vertical center plane of the gap B formed by and between the grippers 240, 241, 242, 243, 244 and 250, 251, 252, 253, 254 of the respective opposing sets of grippers 60 and 62. The constriction member 48 is supported at a bottom thereof and at a top thereof (FIG. 10) to align the constriction member 48 with the natural extension of the shaping chute walls 50 and 54 of the forming assembly 26 (FIGS. 2 and 3). In addition, as is best shown in FIGS. 8 and 9, the constriction member 48 is positioned relative to the upstream end of the pulling assembly 28 such that there is a clearance provided for the respective swing paths of the opposing grippers 240, 241, 242, 243, 244 and 250, 251, 252, 253, 254. It will be appreciated that the constriction member 48 assists in the smooth transition and/or aligning of the strip of dunnage from the forming assembly 26 to the pulling assembly 28, and more particularly to the dunnage transfer region 113 of the pulling assembly 28.

Figure 11A:
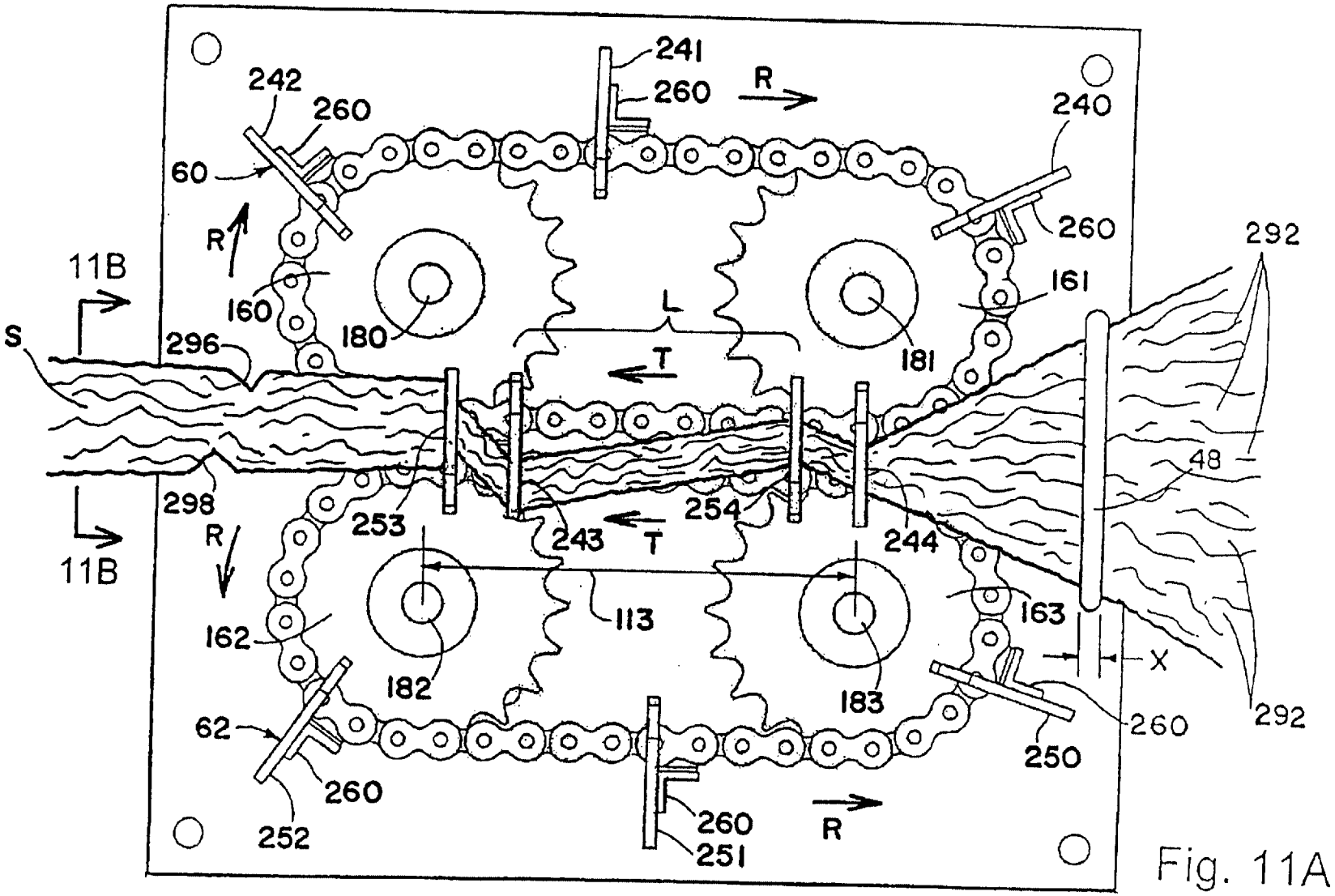
FIG. 11A is a top plan view of the pulling mechanism of FIG. 4 as seen along the line 11A—11A in FIG. 6, wherein a strip of dunnage in accordance with the present invention is shown being translated through a dunnage transfer region of the pulling mechanism.

Referring now to FIG. 11A, there is shown a strip of dunnage S as it is transferred through the dunnage transfer region 113 by the grippers 240, 241, 242, 243, 244 and 250, 251, 252, 253, 254 of the respective transfer assemblies 110 and 112. As is shown, the strip of dunnage S is transversely engaged between grippers 243, 244 and opposing grippers 253, 254 and substantially conforms to the shape of the gap B provided therebetween (FIG. 6). The spacing between the longitudinally spaced axles (axle 181 to 180, or from axle 183 to 182) provides a "moving" relief portion L between sequential opposing grippers, for example, the as shown opposing grippers 243 and 253 and the next in sequence opposing grippers 244 and 254. The relief portion L enables the strip on dunnage S between the opposing grippers 243, 253 and the sequential opposing grippers 244, 254 to temporarily flex, twist or otherwise deform in accordance with the movements of the sequential grippers. This allows the sheet material of the strip of dunnage to orient itself and/or follow the path of least resistance and thereby reduce the tension therein and, accordingly, the likelihood of the sheet material tearing.

Also, it is believed that as opposing grippers 240, 241, 242, 243, 244 and 250, 251, 252, 253, 254 pass through the dunnage transfer region 113 the flexible transfer elements 130, 132 and 140, 142 at least partially flex away from the strip of dunnage, as do the respective opposing grippers 240, 241, 242, 243, 244 and 250, 251, 252, 253, 254, due to, for example, the natural tendency of the resilient sheet material which forms the strip of dunnage to spring back to its original form, i.e., its pre-transversely engaged form. It is believed that this also reduces the tension in the sheet material and, accordingly, the likelihood of the sheet material tearing.

It will also be recognized that grippers and subsequent, or next-in-sequence, grippers continuously and sequentially perform different functions. For example, in the illustrated exemplary pulling assembly 28, downstream opposing grippers 243 and 253 are in transverse engagement of the strip of dunnage S substantially simultaneously as the next-in-sequence upstream opposing grippers 244 and 254 are likewise in transverse engagement of the strip of dunnage S, and as grippers 240 and 250 are moving along the return flight path R about to converge towards the strip of dunnage S at the upstream end of the pulling assembly 28. Subsequently, grippers 240 and 250 will transversely engage the strip of dunnage S (not shown), grippers 244 and 254, already in transverse engagement with the strip of dunnage, will be midstream along the dunnage transfer region 113, advancing the strip of dunnage therethrough, and grippers 243 and 253 will be releasing the strip of dunnage.

It will be appreciated then that the downstream grippers assist the upstream grippers in pulling the strip of dunnage S from the stock support assembly 27 and through the forming assembly 26. Also, the tension imparted in the sheet material due to the pulling thereof by the pulling assembly 28 is spread out over the length of sheet material at and between upstream and downstream grippers in transverse engagement with the strip of dunnage S. This spreading out of the tension in the sheet material reduces the likelihood of tension spikes that may otherwise be experienced if there were only a single point of transverse engagement on and, accordingly, a more concentrated load imparted to, the strip of dunnage. The sequential and progressive pulling and advancing of the strip of dunnage in accordance with the present invention and the consequent reduced tension at multiple engagement regions as above described enables converting of the sheet material into the strip of dunnage at increased speeds while keeping with the objective of obtaining desirable void fill characteristics in the strip of dunnage; that is, the strip of dunnage is both voluminous and has stability.

Referring again to FIG. 11A, the uniformly spaced apart grippers 240, 241, 242, 243, 244 and 250, 251, 252, 253, 254 further form or shape the strip of dunnage as it is pulled from the forming assembly 26 and through the pulling assembly 28. As was described above, the forming assembly 26 inwardly turns lateral edge portions of the sheet material to form a three dimensional strip having substantially longitudinally extending resilient crumpled portions 292. The oval shaped constriction member 48 of the forming assembly 26 narrows, as by squeezing or compressing, the strip of dunnage S into a generally cylindrical shape, preferably reducing the outer dimension, or circumference, thereof, whereby the sheet material thereof forms, in cross-section, a crumpled multi-lobed undulating generally annular body. As a consequence, the crumpled portions 292 form a plurality of longitudinally extending and randomly oriented lobes 294; this being shown, for example, in FIG. 11B, a cross section of the strip of dunnage S as it emerges from the pulling assembly 28. FIGS. 11C and 11D show other cross sections of the strip of dunnage in accordance with the present invention, these demonstrating the random orientation of the lobes 294.

Figure 11B:
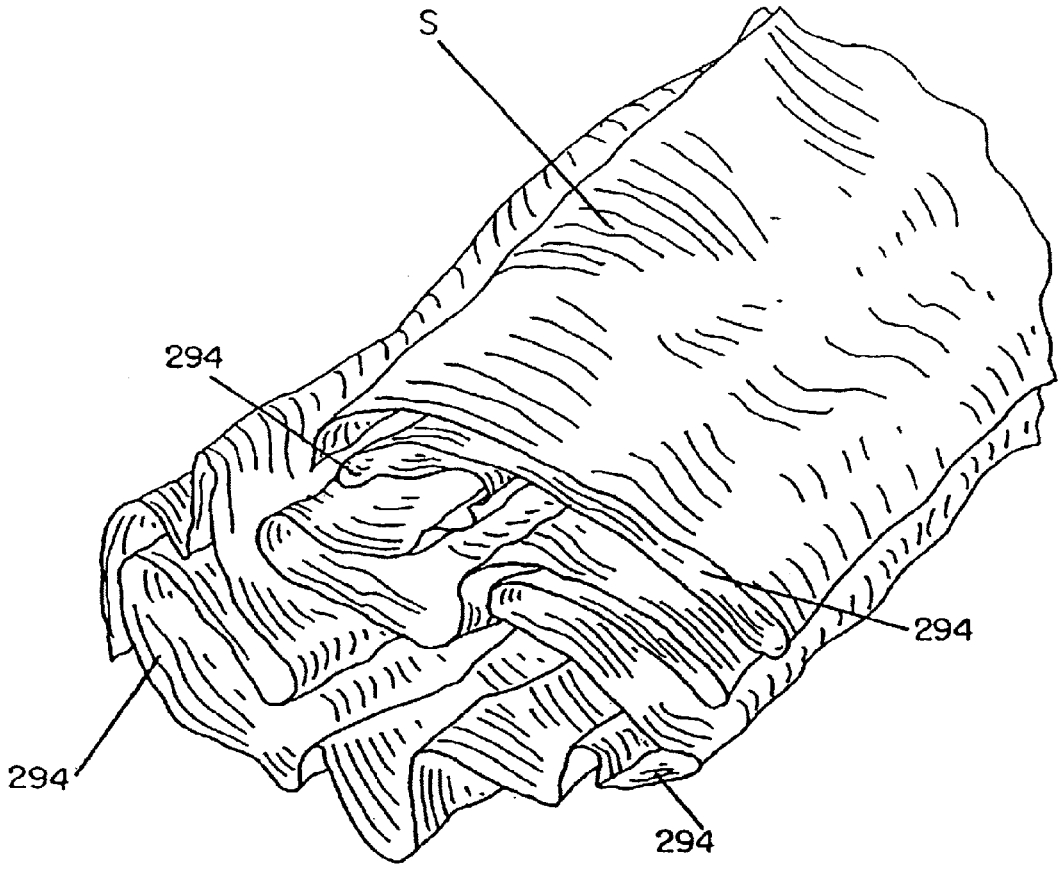
FIG. 11B is a cross-sectional view of the strip of dunnage shown in FIG. 11A, as seen along line 11B—11B in FIG. 11A.
Figure 11C:
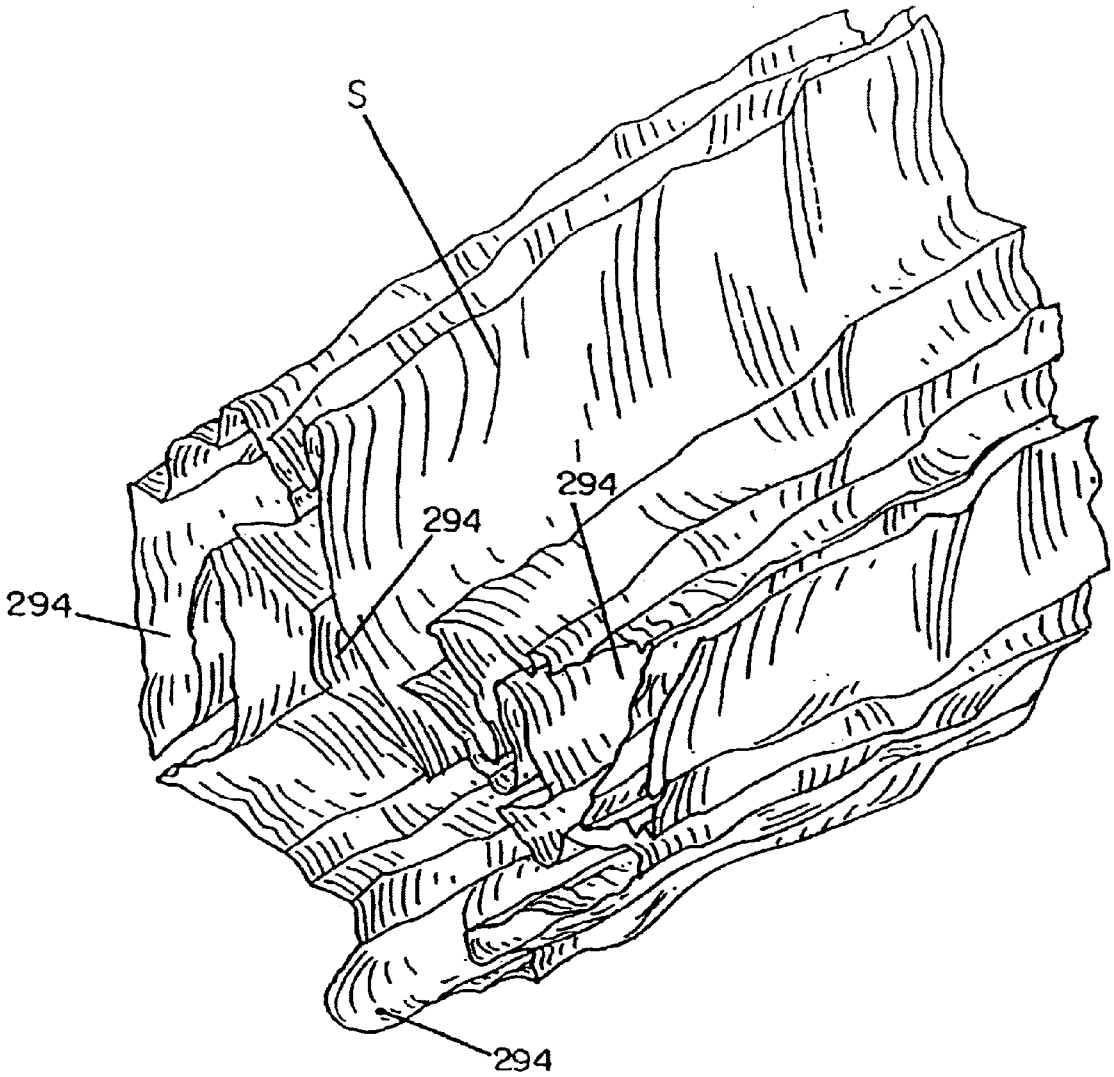
FIG. 11C is a cross-sectional view of a strip of dunnage at a different part along the length of the strip.
Figure 11D:
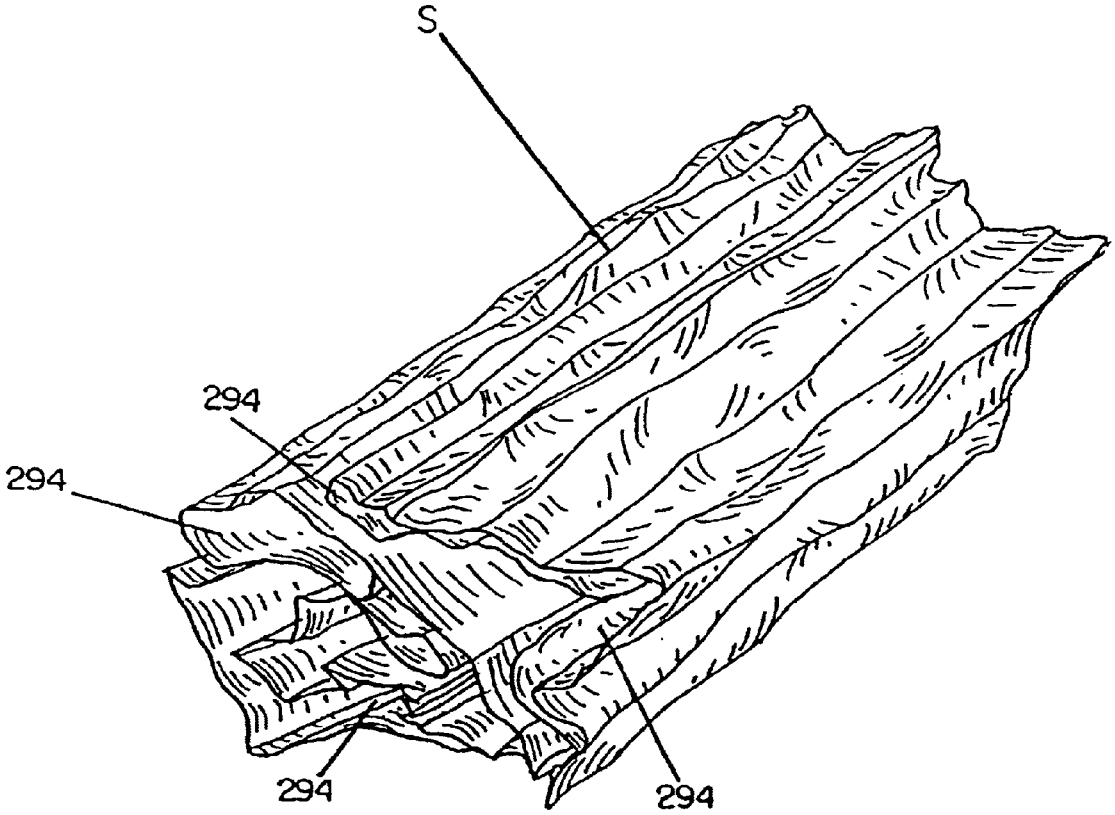
FIG. 11D is a cross-sectional view of a strip of dunnage at a different part along the length of the strip than shown in FIGS. 11B and 11C.

The pulling assembly 28, in turn, advances the strip of dunnage S and further reduces the outer diameter thereof by cross-sectional crumpling of same to form a relatively narrower strip or rope of a generally cylindrical shape (FIGS. 11B, 11C and 11D). The illustrated exemplary pulling assembly 28 forms, crimps and/or kinks 296 and 298 (FIG. 11A) on opposite sides of the strip of dunnage S at regularly spaced intervals, the crimp 296 on one side being preferably offset from the crimp 298 on the opposite side of the strip of dunnage S. The crimps and/or kinks 296 and 298, as alluded to above, assist in enabling the strip of dunnage S to hold its three-dimensional shape.

Figure 12:
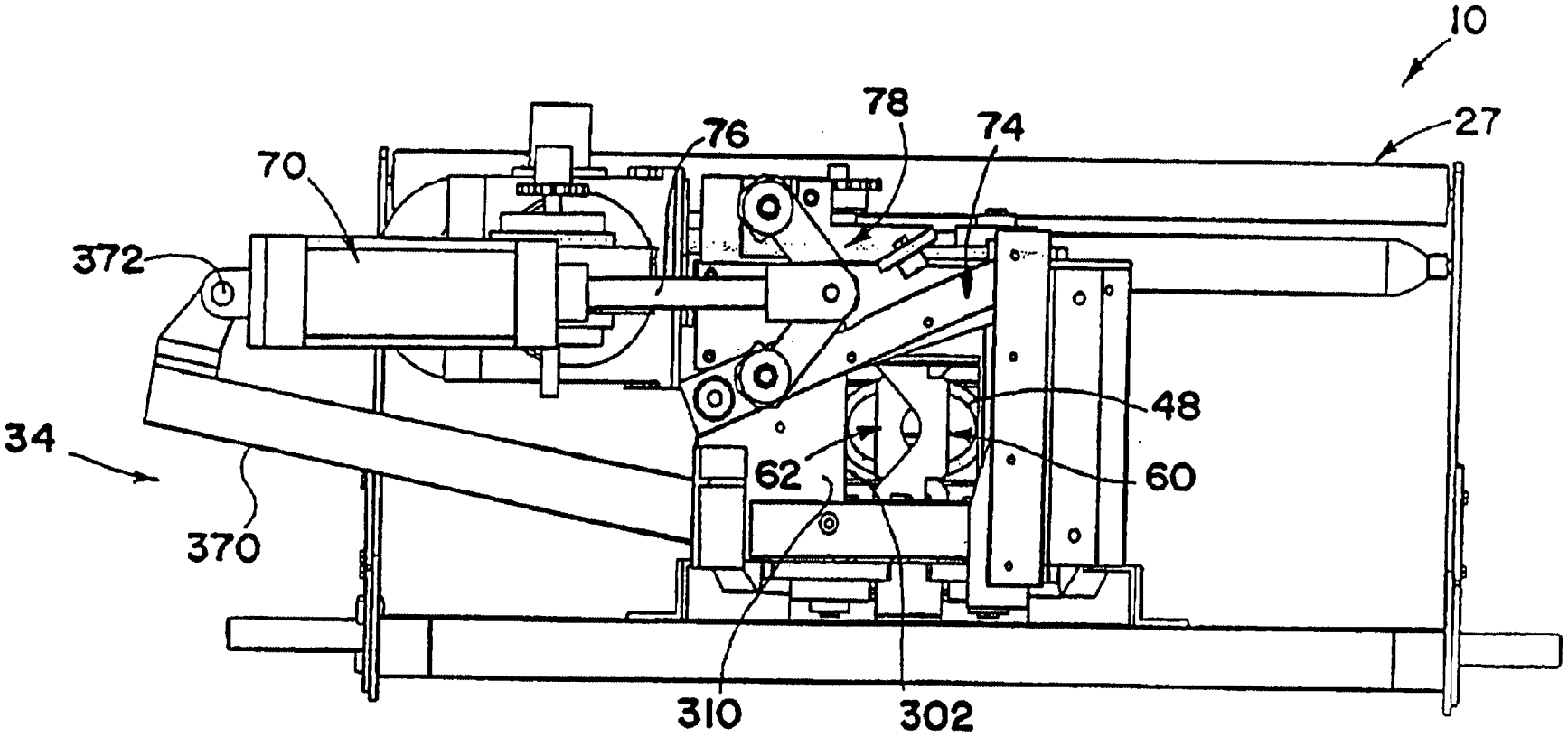
FIG. 12 is an end elevational view of the dunnage conversion machine of FIG. 1.
Figure 13:
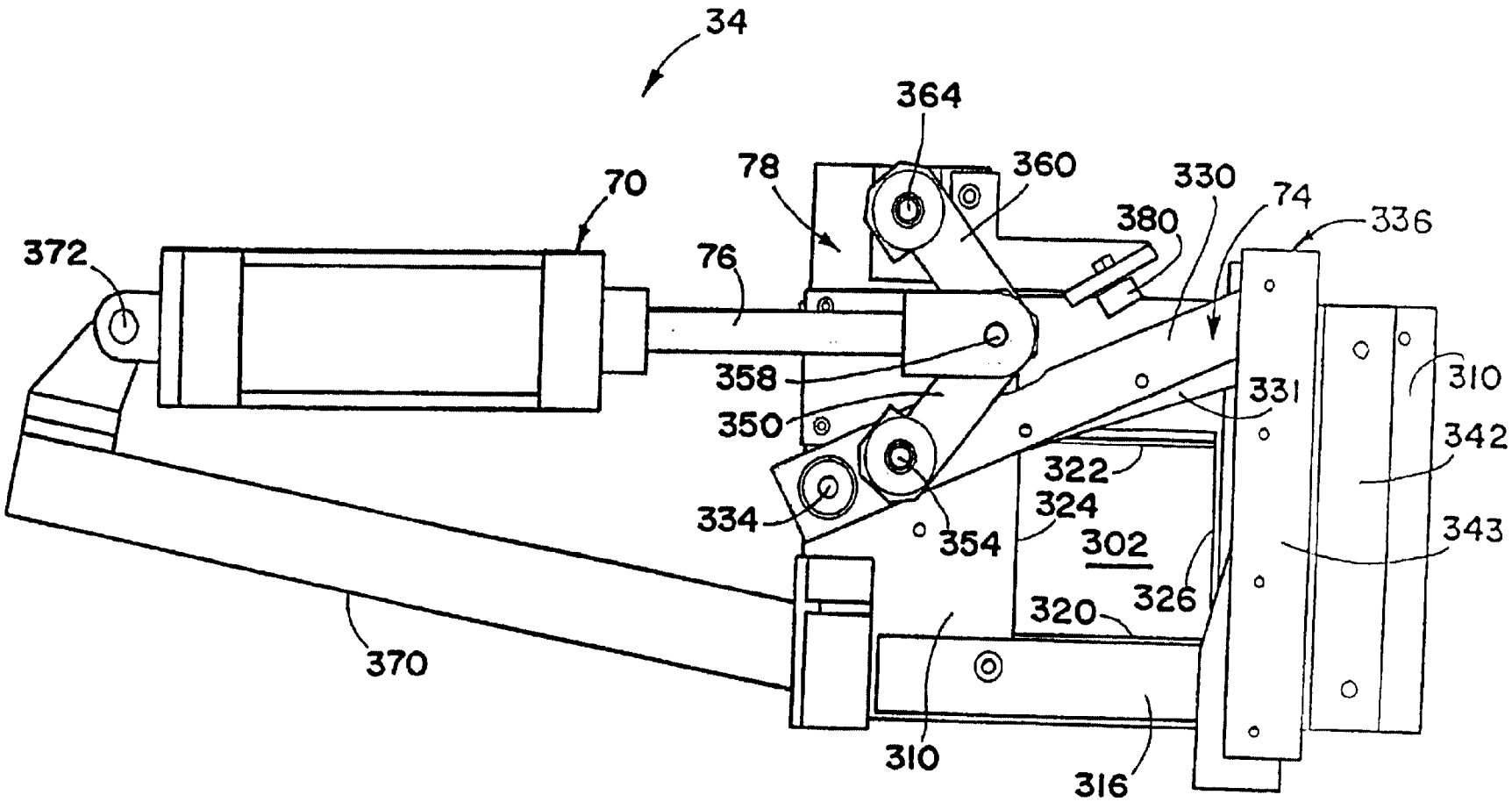
FIG. 13 is an enlarged end elevational view of a severing assembly of the dunnage conversion machine of FIG. 1.
Figure 14:
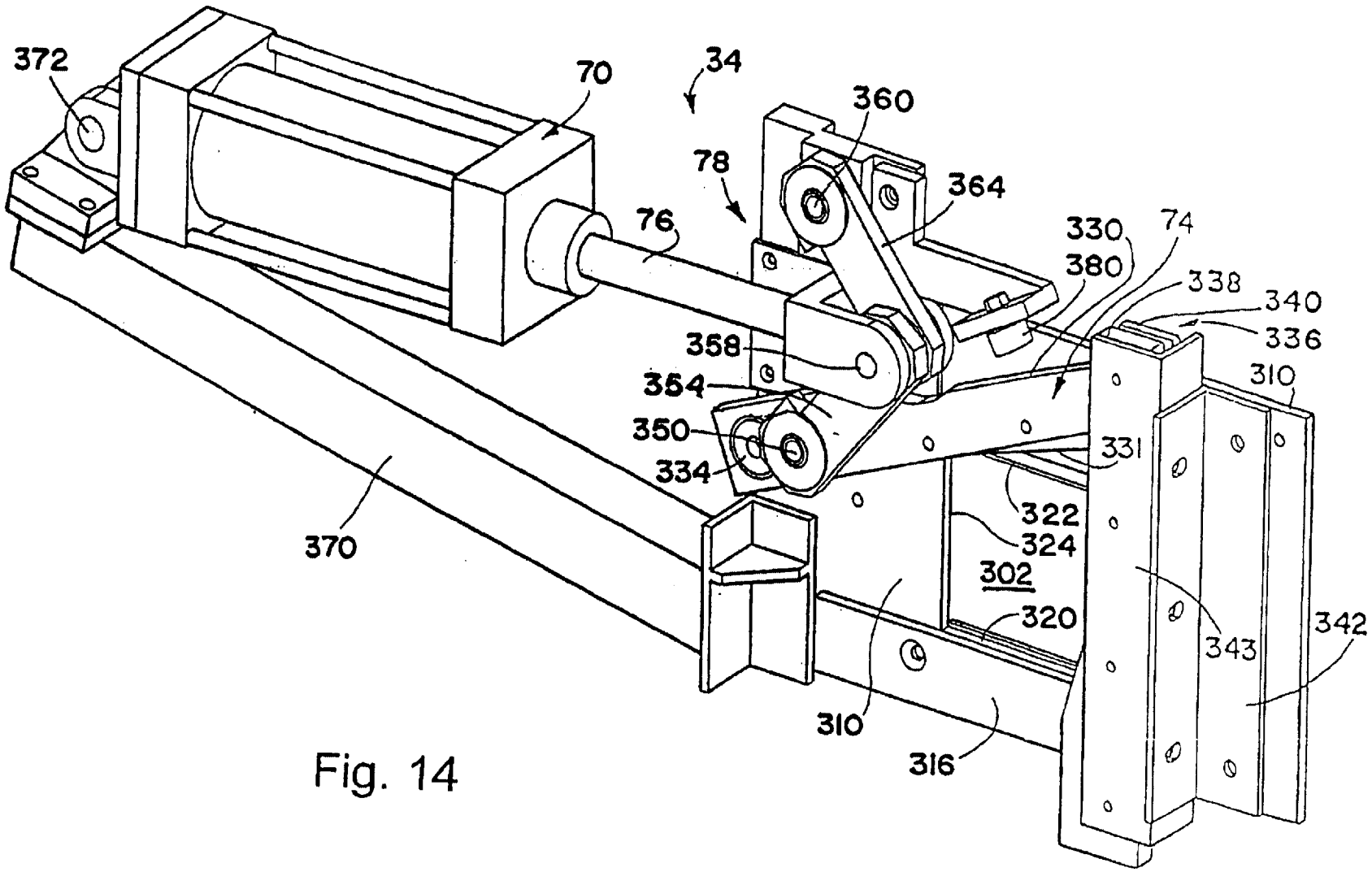
FIG. 14 is a perspective view of the severing assembly of FIG. 13 as seen from a downstream end thereof.
Figure 15:
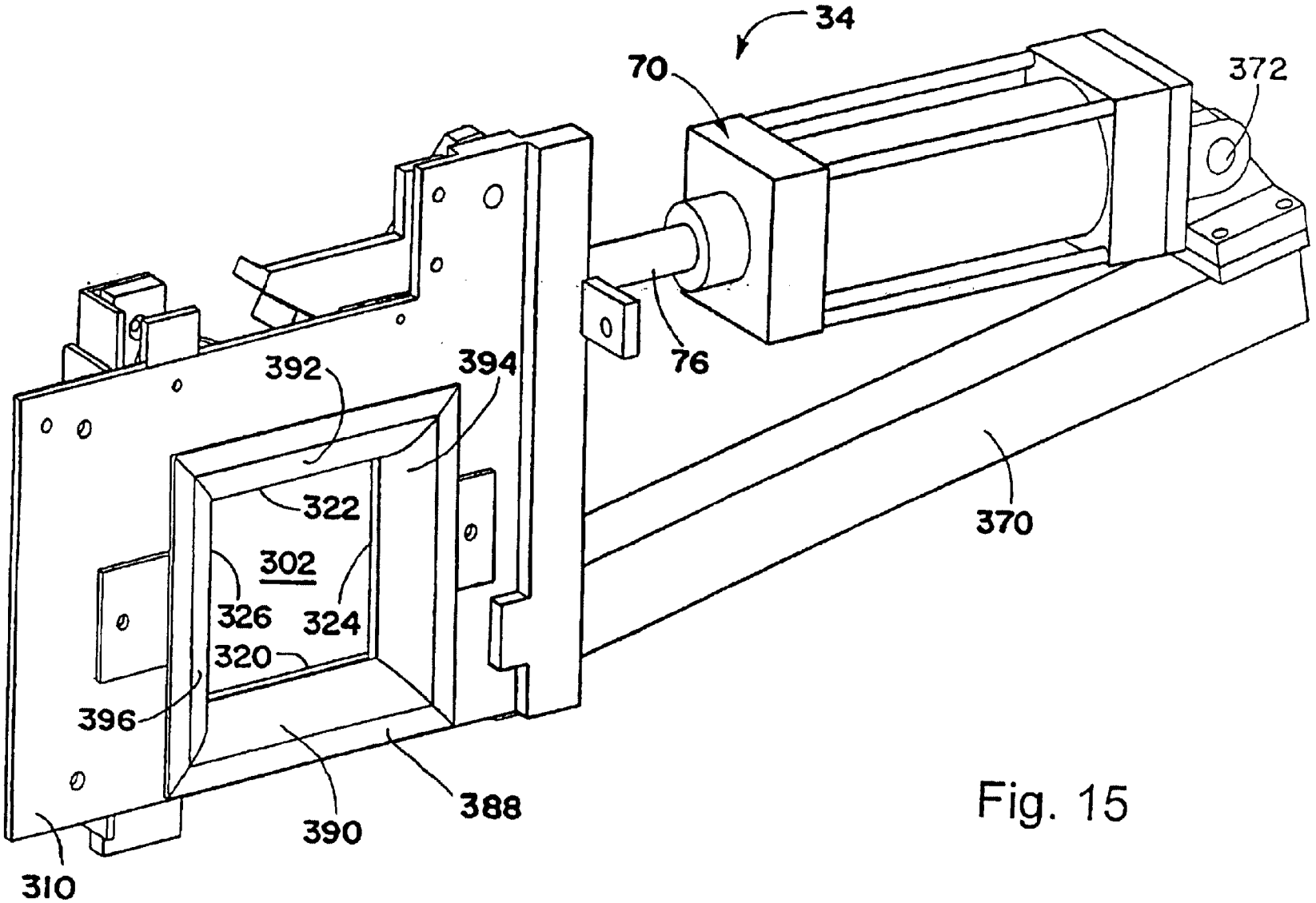
FIG. 15 is a perspective view of the severing assembly of FIG. 13 as seen from an upstream end thereof.

Referring now to FIGS. 12–15, there is shown the severing assembly 34 in accordance with the present invention. As is best seen in FIG. 12, an end view of the dunnage conversion machine 10, the opposing sets of grippers 60 and 62 of the pulling assembly 28 and the oval shaped constriction member 48 of the forming assembly 26 are in alignment with a rectangular shaped dunnage outlet opening 302 of the severing assembly 34. It is through the opening 302 that the continuous strip of dunnage emerges from the pulling assembly 28. As described above, as the continuous strip of dunnage travels downstream from the pulling assembly 28, the severing assembly 34 severs, as by cutting or tearing, the strip of dunnage into sections, or pads, of a desired length. In FIGS. 13–15, components of the severing assembly 34 are illustrated isolated from the rest of the dunnage conversion machine 10.

As is seen in FIG. 1, the severing assembly 34 includes an end plate 310 mounted to the downstream end of the pulling assembly 28. The end plate 310 includes the rectangular dunnage outlet opening 302 through which the continuous strip of dunnage is advance by the pulling assembly 28. The severing assembly 34 includes a stationary blade 316 and the aforementioned movable shear or sliding blade assembly 74, both blade 316 and movable blade assembly 74 being strategically positioned relative to the dunnage outlet opening 302.

Regarding the rectangular outlet opening 302, it is defined by a proximal side 320 (i.e. a lower side), a distal side 322 (i.e. an upper side), and two lateral sides 324 and 326. The terms "proximal" and "distal" in this context refer to the location of the dunnage outlet opening relative to the frame base plate 18. The stationary blade 316 is fixedly mounted on the end plate 310 in such a manner that it is aligned with the proximal side 320 of the dunnage outlet opening 302.

The movable blade assembly 74 preferably comprises a severing arm 330 and a blade 331 attached to a lower end of the severing arm 330. Of course, the severing arm 330 and blade 331 may form an integral part, as desired. The blades 316, 331 are the actual "severing" elements of the severing assembly 34 and coact to sever the continuous strip of dunnage into the severed sections. To this end, the severing may be achieved by physically cutting in a scissor fashion the strip of dunnage with the coacting blades 316, 331. Another way may be by tearing the strip of dunnage along longitudinally spaced transverse perforations in the strip of dunnage as is in, for example, a fan folded sheet material with predetermined spaced apart transverse perforations.

One end of the severing arm 330 is pivotally attached to the end plate 310 via a pivot pin 334. The other end of the severing arm 330 is slidably retained relative to the end plate 310 within a guide track 336. The pivot pin 334 is preferably positioned about midway between the proximal side 320 and distal side 322 of the dunnage outlet opening 302 and laterally offset therefrom by a distance about the same as the width dimension of the opening 302.

As is best seen in FIG. 14, the guide track 336 includes spaced upstream and downstream bearing members 338 and 340, for example, bearing plates, between which the severing arm 330 slidably moves from a ready-to-sever position (i.e., an open position) to a severed position (i.e., a closed position) and back to a ready-to-sever position during a severing cycle, the ready-to-sever position being shown in the Figures. The guide track 336 is mounted to the end plate 310 via a pair of juxtaposed angle brackets 342 and 343 as shown and is positioned parallel to the right lateral side 326 of the dunnage outlet opening 302.

An intermediate part of the severing arm 330 is connected to the aforementioned reciprocating actuator 70 via the motion transmitting assembly 78. More particularly the intermediate part of the severing arm 330 is connected to a lower link 350 of the motion transmitting assembly 78 via a lower link pivot pin 354. The opposite end of the lower link 350 is pivotally attached at a common or joint pivot pin 358 to the aforementioned reciprocating member 76. Also attached to the reciprocating member 76 at the joint pivot pin 358 is an upper link 360 which is pivotally mounted to the end plate 310 via an upper link pivot pin 364.

The lower link 350, the upper link 360 and the reciprocating member 76 thus form a toggle joint at the joint pivot pin 358 whereby as the reciprocating actuator 70 extends the reciprocating member 76 one forward stroke (or retracts the reciprocating member one backward stroke) the reciprocating member 76 exerts a force at joint pivot pin 358, transmitting opposite outward forces to the ends of the lower and upper links 350 and 360, and urging downwardly the lower link pivot pin 354 away from the upper link pivot pin 364. This causes the severing arm 330 and, accordingly the blade 331 attached thereto, to slide to and fro within the guide track 336. Thus, one complete stroke of the reciprocating member moves the movable blade assembly 74 through one cycle of making a severing stroke through the continuous strip of dunnage to a severed or closed position, and a return stroke to a ready-to-sever or open position, which is shown in the Figures.

The illustrated exemplary reciprocating actuator 70 comprises an actuator, for example a pneumatic piston-cylinder assembly, and the reciprocating member 76 comprises an actuator rod which is linearly movable by the reciprocating actuator 70. The reciprocating actuator 70 is mounted to a support member 370 which, in turn, is mounted to an edge of the end plate 310 as shown. As the reciprocating actuator 70 extends and retracts the reciprocating member 76, the reciprocating actuator 70 slightly pivots about a pivot pin 372 positioned at a rear portion of the reciprocating actuator 70.

It is noted that alternatives to the reciprocating actuator or push-pull mechanism 70 may be used to achieve the desired push-pull motion at the joint pivot pin 358, and such alternatives are contemplated as falling within the scope of the presently claimed invention. For example, a disk may be connected to the shaft of a motor for rotation therewith and then have attached to a tangential portion thereof a linkage member whereby as the disk is rotated, the linkage member follows a forward and reverse stroke motion, which can be used to drive the joint pivot pin 358 in accordance with the present invention. Commonly owned U.S. Pat. Nos. 5,123,889, 5,569,146 and 5,658,229 disclose severing assemblies employing motion transmitting elements which may be used to achieve this forward and reverse stroke motion, and are hereby incorporated herein by reference.

A bumper stop 380 is mounted to an upper portion of the end plate 310 to dampen vibrations and/or momentum in the movable blade assembly 74 at the completion of the return stroke thereof. The bumper stop 380 is preferably positioned relative to the dunnage outlet opening 302 at an angle such that the movable blade assembly 74 aligns therewith when the movable blade assembly 74 is in its ready-to-sever position.

Referring to FIG. 15, the severing assembly 34 also includes a four sided flared guide member 388 mounted to the upstream side of the end plate 310. The flared guide member 390 includes four flared walls 390, 392, 394 and 396 corresponding to the four sides 320, 322, 324 and 326 defining the rectangular dunnage outlet opening 302. The flared guide member 388 guides the continuous strip of dunnage into the dunnage outlet opening 302 as the strip of dunnage is advanced to the severing assembly 34 from the pulling assembly 28. The four flared walls 390, 392, 394 and 396 assist in ensuring that edges of the strip of dunnage do not "catch" or are torn by the inside edges of the dunnage outlet opening 302.

Figure 16:
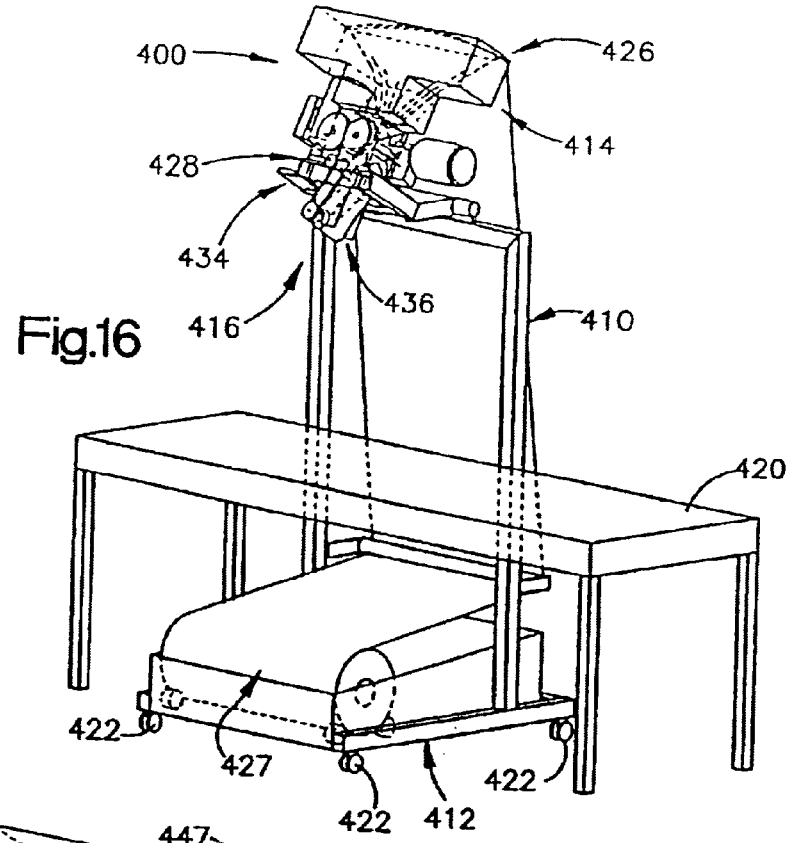
FIG. 16 is a perspective view of a dunnage conversion machine in accordance with another embodiment of the present invention with a housing thereof removed to permit viewing of internal components of the machine, the machine being shown mounted to a stand and extending over a work surface, and the stand including a stock supply assembly.
Figure 17:
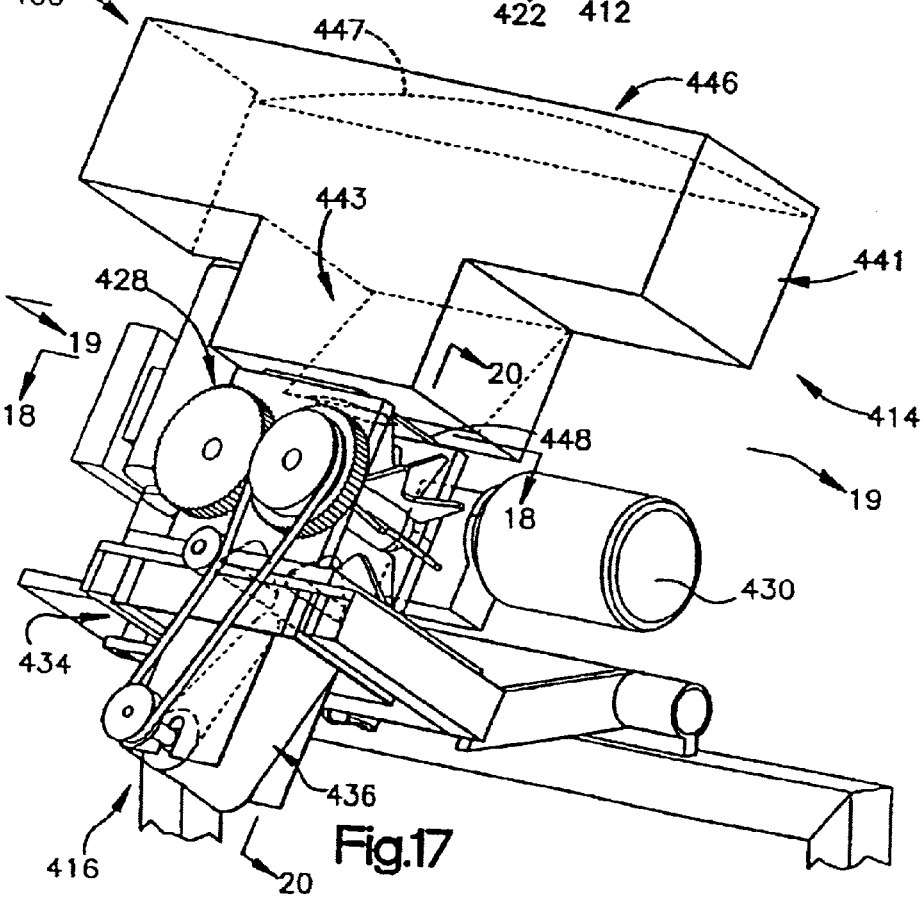
FIG. 17 is an enlarged perspective view of the dunnage conversion machine of FIG. 16.

Referring now to FIGS. 16 and 17, another embodiment of a dunnage conversion machine in accordance with the present invention is generally indicated at reference numeral 400. Like the afore-described dunnage conversion machine 10, the dunnage conversion machine 400 converts a sheet material, such as one or more layers of recyclable and reusable Kraft paper, into a strip of dunnage including, for example, a relatively narrow three dimensional strip or rope of a generally cylindrical shape.

The machine's frame is mounted to a stand 410 (FIG. 16) which is oriented in a generally vertical manner. The stand includes a base 412 and an upright frame to which the machine is mounted. The machine 400 has an upstream end 414 at which sheet stock material is supplied to the machine 400 and a downstream end 416 from which the machine 400 discharges dunnage pads. The stand 410 has an L-shape configuration such that when the base 412 is positioned below a working surface 420, for example a conveyor or, as shown in FIG. 16, a table, the downstream end 416 of the machine 400 extends over the working surface 420. The bottom corners of the base 412 include wheels 422 so that the stand 410 and machine 400 may be moved easily. While not specifically shown/numbered in the drawings, the frame preferably also includes a housing or cover, which is removed to permit viewing of the internal components of the machine 400.

A stock supply assembly 427 supplies sheet stock material to the upstream end 414 of the machine 400. The stock supply assembly 427 is separate from the machine 400 and forms part of the base 412, unlike the afore-described conversion machine 10, in which the stock supply assembly 27 forms part of the conversion machine 10. The stock supply assembly 427 may be any desired type for supplying sheet material to the conversion machine 400.

The dunnage conversion machine 400 includes a forming assembly 426, and a pulling assembly 428 powered (energized) by a motor 430, for example a rotary electric motor. Downstream from the pulling assembly 428, there is provided a severing assembly 434 for severing a continuous strip of dunnage formed by the forming assembly 426 into a desired length pad, and a security device 436 for preventing objects from entering the downstream end of the machine 400. The forming assembly 426, pulling assembly 428, severing assembly 434 and security device 436 are mounted to the frame and/or in the housing of the dunnage conversion machine 400. The operation of the dunnage conversion machine 400 may be controlled by a known controller (not shown).

Figure 18:
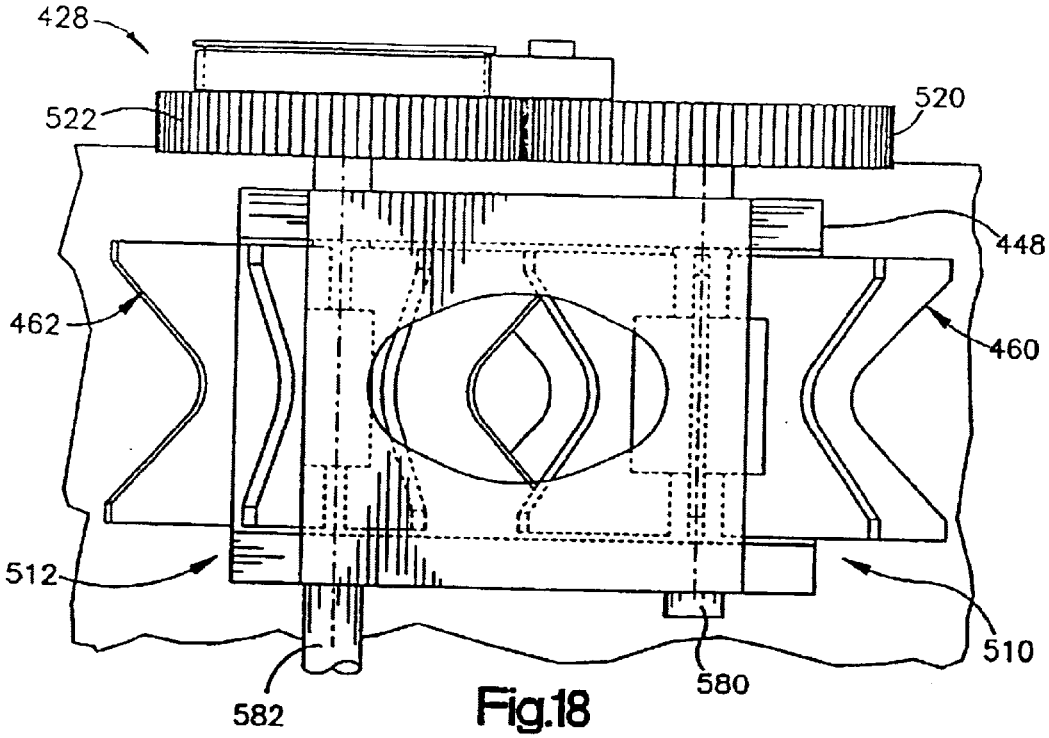
FIG. 18 is an end elevational view of the pulling assembly with a constriction member mounted thereto of the dunnage conversion machine of FIG. 17 as seen along line 18—18 in FIG. 17.
Figure 22:
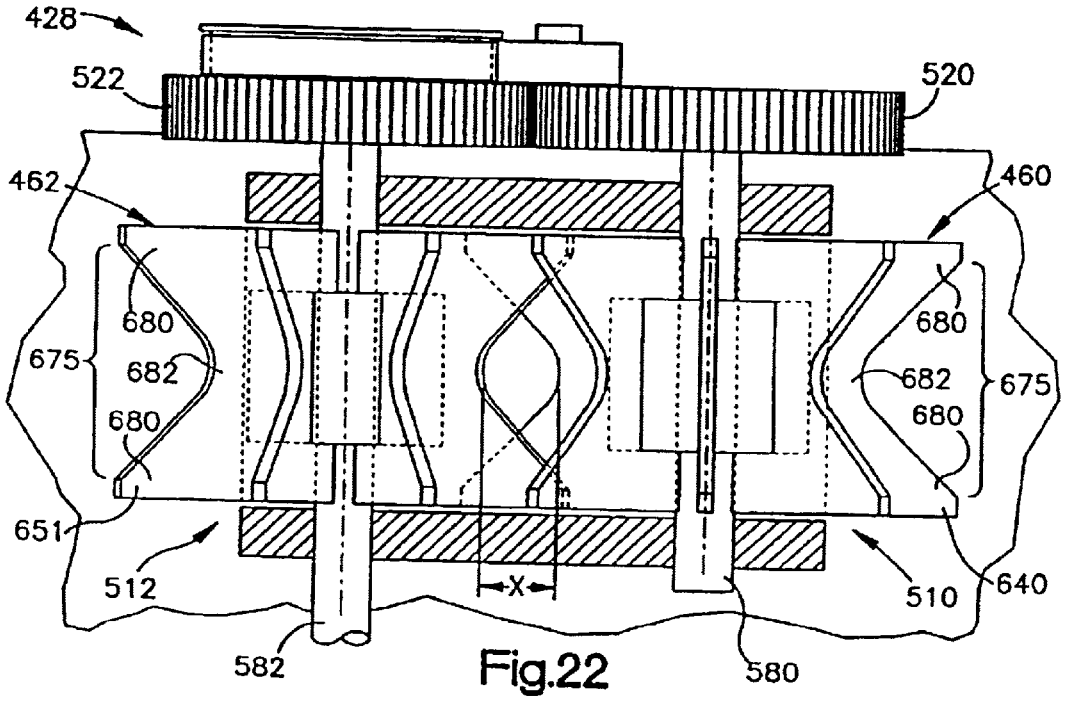
FIG. 22 is an end elevational view of the pulling assembly of the dunnage conversion machine of FIG. 17 as seen along line 22—22 in FIG. 19.

The dunnage conversion machine 400 operates in a manner similar to that of the aforedescribed machine 10. The stock supply assembly 427 supplies sheet material to the forming assembly 426. The illustrated exemplary forming assembly 426 includes a converging shaping chute 446, a curved constant entry bar or member 447, and a constriction member 448 (shown most clearly in FIG. 18). (It is noted that, unlike the forming assembly 26, the forming assembly 426 does not include a forming member 44.) The shaping chute 446 has a an upstream receiving portion 441 and a relatively narrower downstream tunnel portion 443. As the sheet stock material is passed over the curved constant entry bar 447, and through the receiving portion 441 and narrower tunnel portion 443 of the shaping chute 446, the side edge portions of the sheet material are folded or rolled inwardly towards one another so that the inwardly folded edges form multiple substantially longitudinally extending resilient crumpled portions of sheet material, thus preforming and streamlining the sheet material. The tunnel portion 443 guides the sheet material to the constriction member 448 (FIG. 18). As with the afore-described constriction member 48, the constriction member 448 further forms or shapes the sheet material and performs the additional function of directing the formed strip of dunnage into the pulling assembly 428.

The pulling assembly 428 is located downstream from the forming assembly 426 (FIG. 17) and is shown in greater detail in FIGS. 18–22. In accordance with the present invention, the pulling assembly 428 includes a first set of grippers 460 and a second set of cooperating and opposing grippers 462. The grippers 460 and 462 function in a manner similar to that of the grippers 60 and 62 of the pulling assembly 28 illustrated in FIGS. 4–9 and 11A, except that the grippers 460 and 462 are translated along a circular path. In accordance with the invention and, like the earlier described pulling assembly 28, the pulling assembly 428 performs at least one and preferably two functions in the operation of the dunnage conversion machine 400; that is, a feeding function whereby the opposing sets of grippers 460 and 462 progressively transversely engage the strip of dunnage on opposite sides thereof to pull the sheet material from the stock supply assembly 427 (FIGS. 16 and 17) and through the forming assembly 426, and a connecting function whereby the opposing sets of grippers 460 and 462 deform the strip of dunnage on opposite sides thereof to form a connected strip of dunnage. The pulling assembly 428 is described in greater detail below with reference to FIGS. 18–22.

Figure 19:
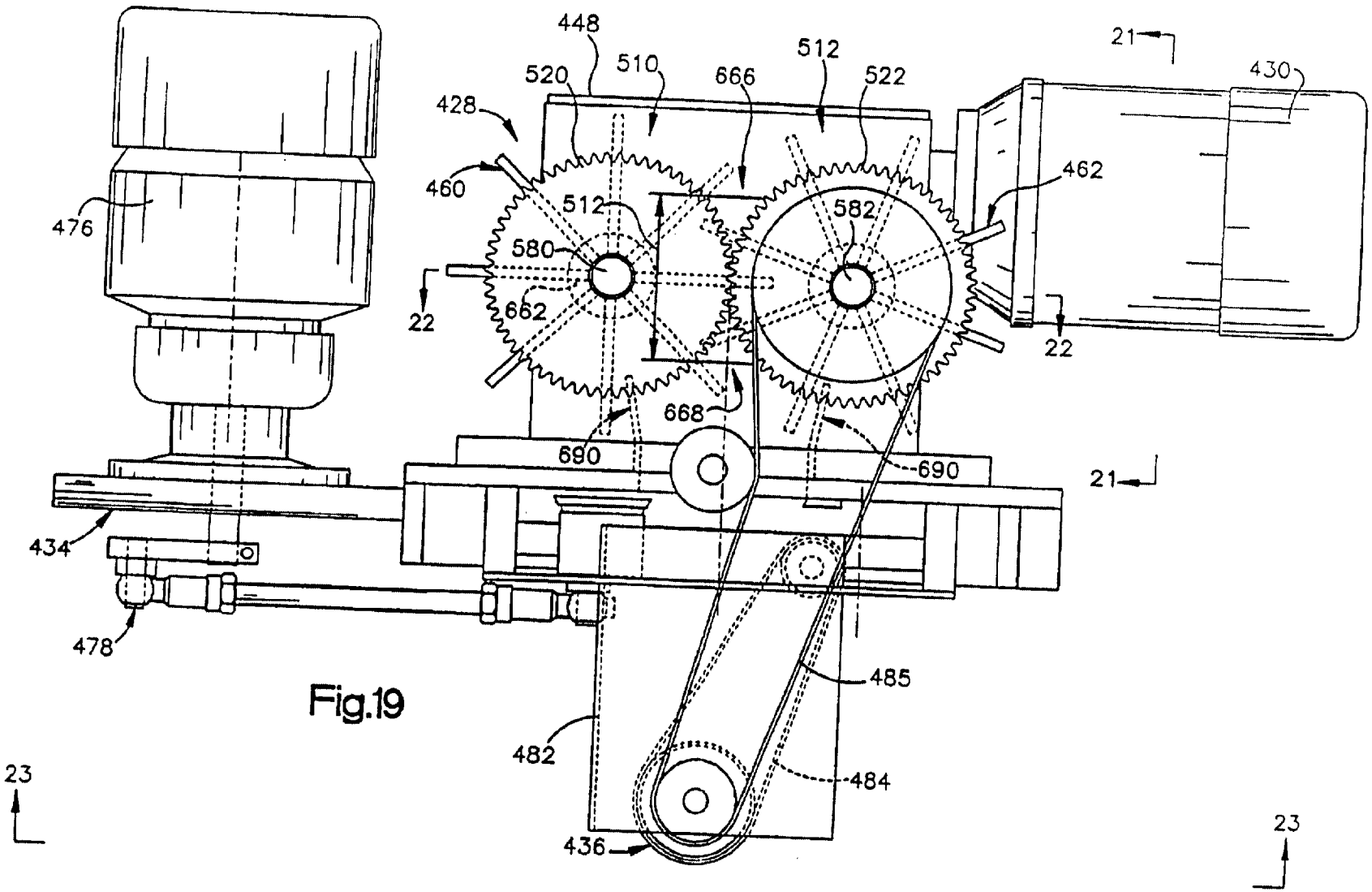
FIG. 19 is a top plan view of a pulling assembly, a severing assembly, and a security device of the dunnage conversion machine of FIG. 17 as seen along line 19—19 in FIG. 17.
Figure 23:
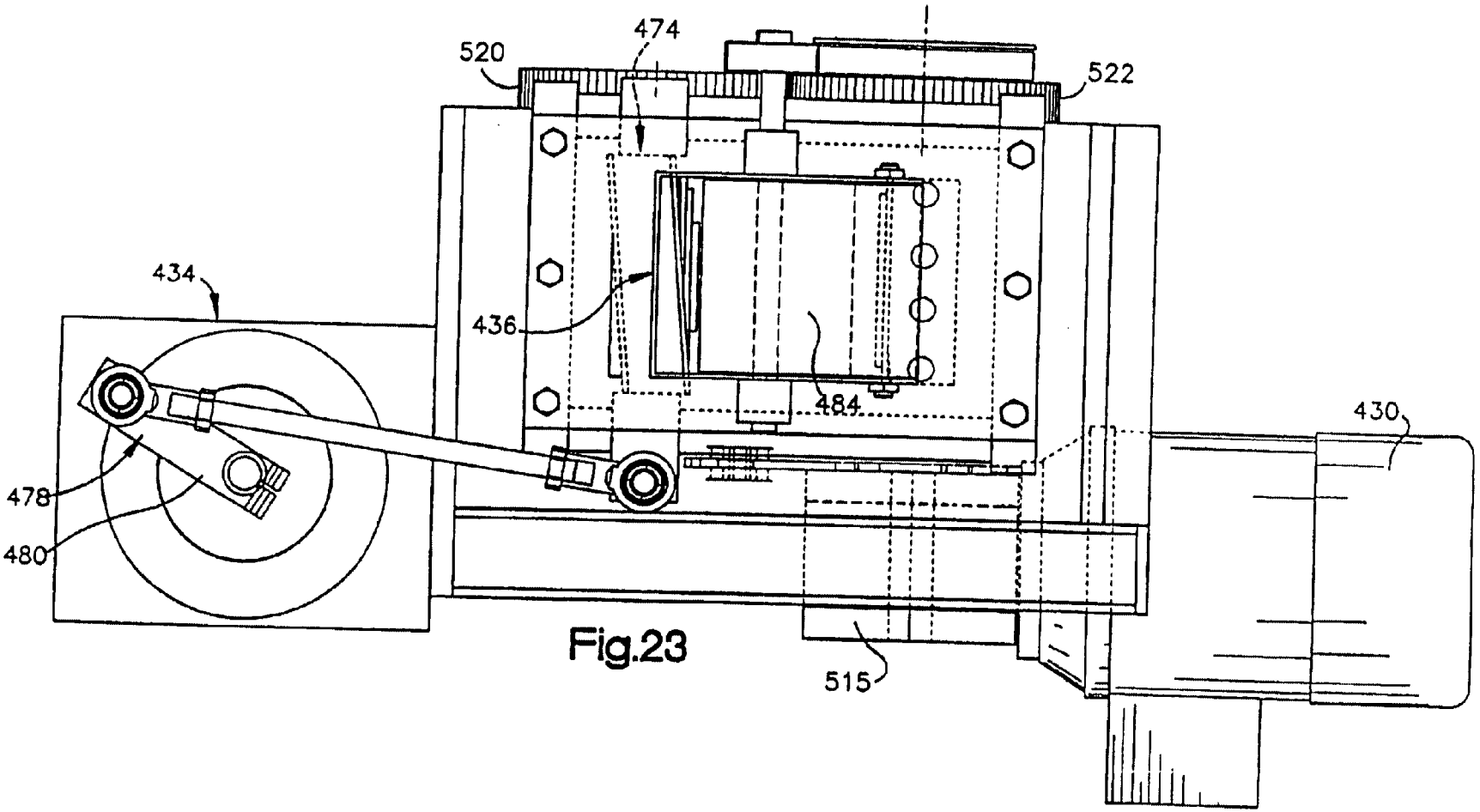
FIG. 23 is an end elevational view of the severing assembly of the dunnage conversion machine of FIG. 17 as seen along line 23—23 in FIG. 19, the severing assembly being shown in a ready-to-sever position.
Figure 24:
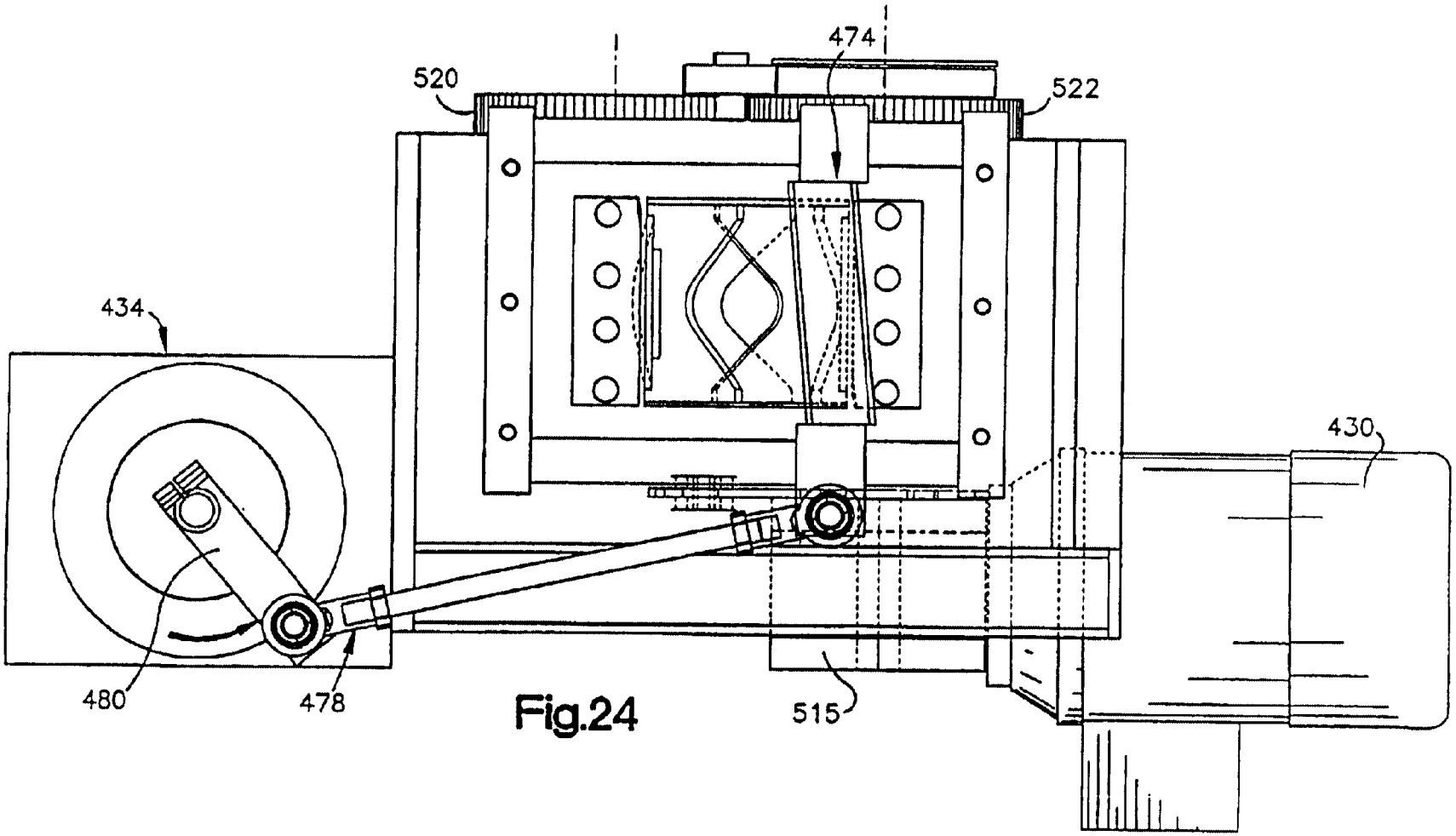
FIG. 24 is an end elevational view of the severing assembly of the dunnage conversion machine of FIG. 17 as seen along line 23—23 in FIG. 19, the severing assembly being shown in a closed position.

Referring again to FIGS. 16 and 17, in the exemplary embodiment, the continuous strip of dunnage travels downstream from the pulling assembly 428 to the severing assembly 434. The severing assembly 434 is shown in FIGS. 19, 23 and 24. The severing assembly 434 severs, as by cutting or tearing, the strip of dunnage into a section of a desired length. The severing assembly 434 may be any desired type for severing the strip of dunnage. The illustrated severing assembly 434 includes a guillotine blade assembly 474 powered by a rotary motor 476 (FIG. 19) via a motion-transmitting assembly 478. A complete rotation of a crank 480 of the motion-transmitting assembly 478 causes the guillotine blade assembly 474 to move from a ready-to-sever, or open, position (FIG. 23) to a severed, or closed, position (FIG. 24) whereby the dunnage strip is severed, and then back to a ready-to-sever position (FIG. 23).

Figure 20:
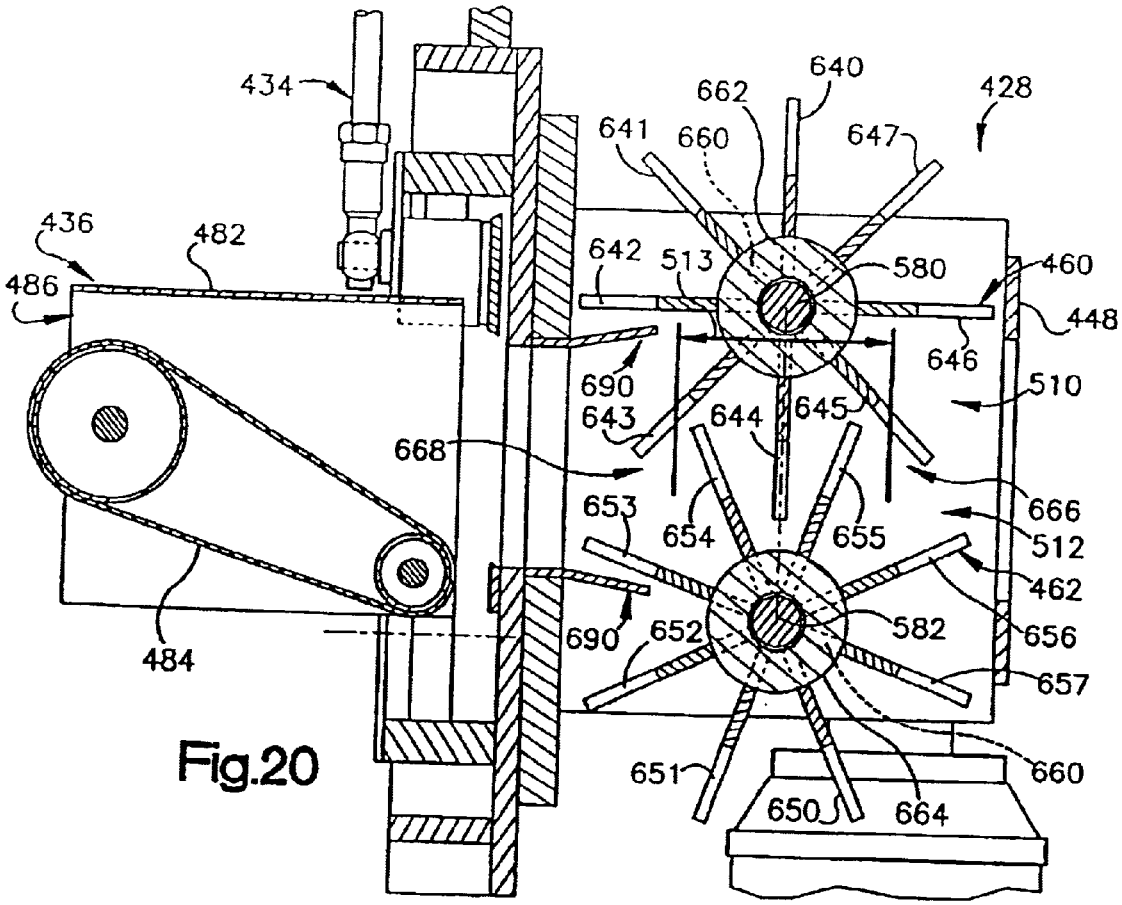
FIG. 20 is a top plan view of the pulling assembly and the security device of the dunnage conversion machine of FIG. 17 as seen along line 20—20 in FIG. 17.
Figure 21:
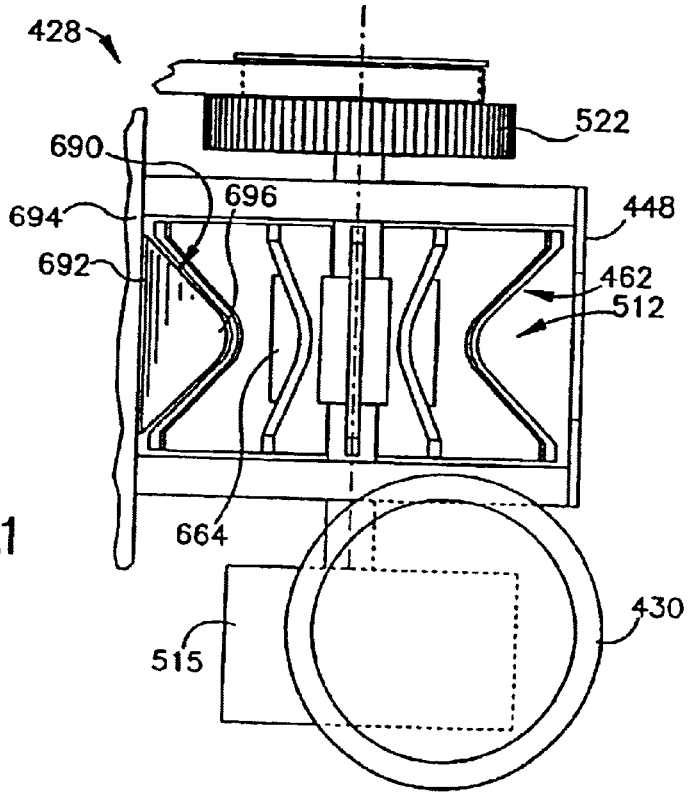
FIG. 21 is a side elevational view of the pulling assembly of the dunnage conversion machine of FIG. 17 as seen along line 21—21 in FIG. 19.

The security device 436 is located downstream from the severing assembly 434. The security device 436 is shown in FIGS. 19 and 20. The security device 436 includes a rectangular shaped outlet chute 482 and a conveyor 484 mounted to and/or in the chute 482. The conveyor 484 is inclined from an upstream end of the chute 482 (near the severing assembly 434) to a downstream end of the chute 482. The chute 482 and the inclined conveyor 484 form a relatively narrow opening 486 at the downstream end of the chute 482 to prevent objects from entering same. It will be appreciated that other security devices may be used to prevent foreign objects from entering the exit chute of the machine 400.

The inclined conveyor 484 is powered by the motor 430 of the pulling assembly 428 via, for example, a timing belt 485. In operation, the conveyor 484 frictionally engages the strip of dunnage and assists in conveying the dunnage strip through the output chute 482.

It will be appreciated, then, that the conversion machine 400 according to the present invention provides improvements in the dunnage conversion machine art that in many respects are similar to those provided by the earlier described conversion machine 10. In this regard, the present invention discloses novel opposing sets of grippers 460 and 462 which, like the grippers 60 and 62, enable gradual transverse engagement and progressive advancement of the strip of dunnage across the full width of the strip so as to prevent, or at least reduce the likelihood of, the afore-described abrupt tearing sometimes experienced by previously known conversion machines.

Referring to FIGS. 18–22, the pulling assembly 428 according to the present invention is shown in greater detail. The pulling assembly 428 includes a pair of transfer assemblies 510 and 512 which define therebetween a dunnage transfer region 513 (FIGS. 19 and 20) through which the strip of dunnage from the forming assembly 426 passes. The transfer assemblies 510 and 512 are driven by the motor 430. More particularly, the motor 430 is connected to the transfer assembly 512 via a speed reducer 515 (FIGS. 23 and 24) which is operable to control and/or adjust the speed transferred from the motor 430 to the transfer assembly 512. The transfer assembly 512 includes a drive gear 522 mounted to an axle 582 and the transfer assembly 510 includes a driven gear 520 mounted to an axle 580, the axle 580 being parallel and laterally spaced relative to the axle 582 (see FIGS. 18–20 and 22). The drive gear 522 of the transfer assembly 512 coacts with the driven gear 520 of the transfer assembly 510 to drive the transfer assembly 510 in a direction opposite that of the transfer assembly 512. The coacting gears 520 and 522 are the same size and, consequently, the speed at which the transfer assemblies 510 and 512 rotate is the same. The axles 580 and 582 are supported at their opposite ends in bearings (not shown).

In the illustrated exemplary embodiment, the opposing sets of grippers 460 and 462 respectively include a first set of uniformly circumferentially spaced apart grippers 640–647 and a second opposing set of uniformly circumferentially spaced apart grippers 650–657 (FIG. 20). The illustrated grippers 640–647 and 650–657 are secured in corresponding slots 660 defined by respective hubs 662 and 664 which, in turn, are mounted to the respective axles 580 and 582 for rotation therewith. The opposing sets of grippers 460 and 462 together form the above mentioned dunnage transfer region 513 (FIGS. 19 and 20) through which the strip of dunnage is gradually transversely engaged, advanced, and released. It is noted that, unlike the dunnage transfer region 113 of the earlier described pulling assembly 28, which extends longitudinally approximately from the first set of laterally spaced axles 181 and 183 to the second set of laterally spaced axles 180 and 182, the dunnage transfer region 513 of the present pulling assembly 428 extends from about a region 666 upstream from the laterally spaced axles 580 and 582 to about a region 668 downstream from the same laterally spaced axles 580 and 582. In other words, the strip of dunnage is transferred or advanced between two pairs of axles in the earlier described pulling assembly 28 and only one pair of axles in the pulling assembly 428.

The grippers 640–647 and 650–657 of the pulling assembly 428 generally have a geometry similar to that of the grippers of the earlier described pulling assembly 428. Thus, each gripper 640–647 and 650–657 has a somewhat V-shaped, or outwardly opening, aperture 675. On opposite sides of the outwardly opening aperture 675 are contact portions (i.e., the arms that form the V-shape opening), which include arm portions 680 (i.e., side contact portions) which are bridged by a base portion 682 (i.e., a central contact portion). The apertures 675 of opposing grippers 640–647 and 650–657 together form a gap X (FIG. 22) therebetween which gradually becomes narrower as the grippers 640–647 and 650–657 progressively move towards each other. The narrowing of the gap X between the grippers 640–647 and 650–657 eventually reaches a minimal gap size by which the strip of dunnage is fully transversely engaged or captured by the opposing grippers 640–647 and 650–657. In other words, the arm portions 680 of the opposing grippers 640–647 and 650–657 move transversely towards (i.e., "close in" on) each other and the base portions 682 of the opposing grippers 640–647 and 650–657 move transversely towards (i.e., close in" on) each other altogether to grip or capture the strip of dunnage therebetween.

Once the opposing grippers 640–47 and 650–57 have transversely engaged the strip of dunnage, the opposing grippers 640–47 and 650–57 maintain a grip on the strip of dunnage for the duration of their travel through the dunnage transfer region 513. During passage through the transfer region 513 the strip of dunnage is crimped and/or deformed on opposite sides thereof in a manner similar to that described above with respect to the conversion machine 10 (see FIGS. 11B, 11C and 11D, and the description relating thereto.) At the downstream end of the pulling assembly 428, and more particularly the downstream end of the dunnage transfer region 513, the opposing sets of grippers 460 and 462 gradually diverge away from each other to release the strip of dunnage.

It will be appreciated that, as with the earlier described pulling assembly 28, the quantity and/or type of grippers 640–647 and 650–657 employed may be other than that shown in the several Figures depending on, for example, the desired circumferential spacing between the grippers, the desired point at which the strip of dunnage is engaged by the grippers (e.g., relatively longer grippers may engage the strip of dunnage sooner and/or further upstream than relatively shorter grippers), the geometric configuration of the grippers (e.g., the outwardly opening apertures 675 may be semicircular or semi-oval in shape to achieve the lateral and transverse capturing), or the type of engagement desired by the grippers (e.g., whether it is desired to have the strip of dunnage connected by the grippers). It will also be appreciated that, as with the afore-described pulling assembly 28, the grippers 640–47 of one transfer assembly 510 may be longitudinally offset by a gap in relation to the grippers 650–57 of the other opposing transfer assembly 512. Still further, it will be appreciated that the pulling assembly 428, like the pulling assembly 28, may function as a feeding assembly and/or a connecting assembly. The illustrated exemplary pulling assembly 428 both pulls the sheet material (i.e., feeds the sheet material) through the forming assembly 426 and progressively crimps and/or kinks (i.e., connects) the strip of dunnage at regular intervals as it passes through the pulling assembly 428. Other means of connecting may also be employed, as alluded to above.

Referring now to FIGS. 19–1, there is shown a pair of guide fingers 690 which project in a downstream-to-upstream direction on opposite sides of the path of travel of the strip of dunnage. Proximal ends 692 of the fingers 690 are attached to a downstream wall 694 of the pulling assembly 428. Distal ends 696 of the fingers 690 point towards the centerline of the respective axles 580 or 582 occupying the same side of the pulling assembly 428. The fingers 690 have a shape which compliments the shape of the outwardly opening apertures 675 of the grippers 640–47 and 650–57.

In operation, as a gripper 640–47 and 650–57 diverges away from the transfer region 513 to release the strip of dunnage, the gripper, as it sweeps by the corresponding guide finger 690, will receive the guide finger 690 in its corresponding outwardly opening aperture 675, causing the gripper and finger 690 to "match up". Thereafter, the guide finger 690 guides the strip of dunnage downstream to the severing assembly 434 and prevents the strip of dunnage from transversely straying from the dunnage transfer region 513. As the gripper continues diverging away from the dunnage transfer region 513, the next or succeeding gripper aligns itself with the finger 690 and the finger guide 690 again, thereafter, guides the strip of dunnage to the severing assembly 434 and prevents the strip of dunnage from transversely straying from the dunnage transfer region 513. The guide fingers 690 guide the strip of dunnage away from the dunnage transfer region 513 and to the severing assembly 434.

In the illustrated embodiments of the pulling assemblies 28 and 428, opposing grippers are shown as each having an aperture. The presently claimed invention also contemplates opposed grippers wherein only one of the grippers includes an aperture. In accordance with the invention, the gripper including the aperture operates to gather and laterally capture therein the dunnage strip as the gripper along with the opposing gripper without the aperture move through the transfer region. The present invention also contemplates opposing grippers having different shapes (for example, semicircle or semi-oval) and/or size apertures.

As above indicated, the conversion machines 10 and 400 may be operated by a controller. The controller, for example, may cause the drive motor to be energized when a foot pedal is depressed by the operator. The machine may produce a pad for as long as the pedal is depressed. When the pedal is released the controller may cease operation of the drive motor and effect operation of the severing motor to sever the strip of dunnage. Other control means may be provided such as that described in U.S. Pat. Nos. 5,897,478 and 5,864,484.

Although the invention has been shown and described with respect to a certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A dunnage conversion machine for converting sheet material into a dunnage product, comprising:

a forming assembly for shaping the sheet material into a continuous strip of dunnage including a three-dimensional shape; and a pulling assembly positioned downstream from the forming assembly for advancing the sheet material through the forming assembly;

the pulling assembly including at least two grippers, at least one of which is movable through a transfer region in opposition to the other gripper and cooperative to grip therebetween the dunnage strip for advancing the dunnage strip through the transfer region, and at least one of the grippers including an aperture operative to gather and laterally capture therein the dunnage strip as the movable gripper moves through the transfer region, wherein the aperture is V-shape.

2. The dunnage conversion machine of claim 1, wherein the V-shape aperture has a rounded bottom.

3. A dunnage conversion machine for converting sheet material into a dunnage product, comprising:

a forming assembly for shaping the sheet material into a continuous strip of dunnage including a three-dimensional shape; and a pulling assembly positioned downstream from the forming assembly for longitudinally advancing the sheet material through the forming assembly;

the pulling assembly including at least two opposed grippers, at least one of which is movable through a transfer region in transverse opposition to the other gripper and cooperative to grip therebetween the dunnage strip for advancing the dunnage strip through the transfer region, and at least one of the grippers including laterally spaced apart portions defining therebetween an aperture operative to gather and laterally capture therein the dunnage strip as the movable gripper moves through the transfer region, wherein the two opposed grippers are movable together through the transfer region, and said two opposed grippers movable together through the transfer region move through the transfer region in longitudinally offset yet paired relation for gripping and advancing the strip of dunnage.

4. A dunnage conversion machine for converting sheet material into a dunnage product, comprising:

a forming assembly for shaping the sheet material into a continuous strip of dunnage including a three-dimensional shape; and a pulling assembly positioned downstream from the forming assembly for longitudinally advancing the sheet material through the forming assembly;

the pulling assembly including at least two opposed grippers, at least one of which is movable through a transfer region in transverse opposition to the other gripper and cooperative to grip therebetween the dunnage strip for advancing the dunnage strip through the transfer region, and at least one of the grippers including laterally spaced apart portions defining therebetween an aperture operative to rather and laterally capture therein the dunnage strip as the movable gripper moves through the transfer region, wherein said two opposed grippers are movable together through the transfer region, and said at least two opposed grippers movable together through the transfer region transversely overlap while advancing the strip of dunnage.

5. The dunnage conversion machine of claim 4, wherein the aperture tapers in width going from an outer to an inner end of the gripper.

6. The dunnage conversion machine of claim 4, wherein the two opposed grippers have contact regions operative to deform opposite sides of the strip of dunnage to capture the strip of dunnage between the two opposed grippers.

7. The dunnage conversion machine of claim 4, wherein the grippers are arranged in transversely opposed sets of grippers disposed on opposite transverse sides of the transfer region.

8. The dunnage conversion machine of claim 4, wherein at least one of the grippers is in the form of a broad flat blade.

9. The dunnage conversion machine of claim 4, wherein the forming assembly includes a constriction member through which the sheet material is pulled to effect crumpling thereof and forming of the strip of dunnage.

10. The dunnage conversion machine of claim 9, wherein the constriction member is a ring.

11. The dunnage conversion machine of claim 9, wherein the ring is oval and has rounded edges at the upstream end thereof.

12. The dunnage conversion machine of claim 4, wherein the forming assembly includes a constriction member at an upstream end thereof which constricts and guides the strip of dunnage from a downstream end of the forming assembly to an engagement region between the opposing grippers.

13. The dunnage conversion machine of claim 12, wherein the constriction member defines an oval aperture through which the strip of dunnage is compressed circumferentially, the width of the aperture being smaller than the width of the sheet material.

14. A dunnage conversion machine for converting sheet material into a dunnage product, comprising:

a forming assembly for shaping the sheet material into a continuous strip of dunnage including a three-dimensional shape; and a pulling assembly positioned downstream from the forming assembly for longitudinally advancing the sheet material through the forming assembly;

the pulling assembly including at least two opposition grippers, at least one of which is movable through a transfer region in transverse opposition to the other gripper and cooperative to grip therebetween the dunnage strip for advancing the dunnage strip through the transfer region, and at least one of the grippers including laterally spaced apart portions defining therebetween an aperture operative to gather and laterally capture therein the dunnage strip as the movable gripper moves through the transfer region, wherein the grippers are arranged in transversely opposed sets of grippers disposed on opposite transverse sides of the transfer region, and the grippers of the opposed sets progressively move towards one another at an upstream end of the transfer region and progressively move away from one another at a downstream end of the transfer region.

15. The dunnage conversion machine of claim 14, wherein the grippers of each set are circumferentially spaced around a respective common axis and are joined together for rotation about the respective common axes.

16. The dunnage conversion machine of claim 15, wherein the grippers of each set extend radially from the respective common axes.

17. The dunnage conversion machine of claim 15, wherein the grippers are uniformly circumferentially spaced apart around the respective common axes.

18. The dunnage conversion machine of claim 14, wherein the pulling assembly further includes a set of transfer assemblies having connected thereto the respective sets of grippers, the transfer assemblies being operative to move the grippers of the respective set toward one another at the upstream end of the transfer region to transversely engage the strip of dunnage and away from one another at the downstream end of the transfer region to release the strip of dunnage.

19. The dunnage conversion machine of claim 18, wherein the grippers of each set are movable along respective non-circular paths, and wherein the transfer region is defined along juxtaposed transfer region portions of the respective non-circular paths, and wherein the grippers are movable through the transfer region in opposite relation to one another and are operative sequentially, as the grippers move through the transfer region in opposite relation, to transversely engage the strip of dunnage therebetween on opposite sides thereof for advancing therewith the strip of dunnage.

20. The dunnage conversion machine of claim 19, wherein opposing grippers moving downstream of the transfer region release the strip of dunnage substantially simultaneously with or after opposing grippers moving upstream of the transfer region transversely engage the strip of dunnage.

21. The dunnage conversion machine of claim 19, wherein opposing grippers moving downstream of the transfer region release the strip of dunnage substantially simultaneously with or after opposing grippers moving upstream of the transfer region advance the strip of dunnage.

22. The dunnage conversion machine of claim 19, wherein each transfer assembly includes a flexible transfer element and a pair of wheels mounted on respective longitudinally spaced axles, the flexible transfer element having portions thereof trained over the pair of wheels, and wherein the grippers of said respective opposing sets of grippers extend from said respective flexible transfer elements such that at least one gripper from each of said respective opposing sets of grippers are in operative engagement with the strip of dunnage when moving through the transfer region.

23. The dunnage conversion machine of claim 22, wherein the grippers of each set extend perpendicularly from the respective flexible transfer element.

24. The dunnage conversion machine of claim 22, wherein, along the transfer region portions of the respective non-circular paths of the sets of grippers, the at least one gripper from one set of grippers is longitudinally offset relative to the at least one gripper of the opposing set of grippers to provide clearance between the opposing grippers as the grippers move towards one another at the upstream end of the transfer region.

25. The dunnage conversion machine of claim 22, wherein the flexible transfer elements of the transfer assemblies comprise articulating chains.

26. The dunnage conversion machine of claim 22, wherein the flexible transfer elements of the transfer assemblies comprise flexible belts.

27. The dunnage conversion machine of claim 22, wherein movement of the flexible transfer elements is synchronized.

28. The dunnage conversion machine of claim 18, wherein the grippers are arranged in transversely opposed sets of grippers disposed on opposite transverse sides of the transfer region, and wherein the grippers of each set are movable along respective circular paths, and wherein the transfer region is defined along juxtaposed transfer region portions of the respective circular paths, and wherein the grippers are movable through the transfer region in opposite relation to one another and are operative sequentially, as the grippers move through the transfer region in opposite relation, to transversely engage the strip of dunnage therebetween on opposite sides thereof for advancing therewith the strip of dunnage.

29. The dunnage conversion machine of claim 28, wherein the opposing sets of grippers are mounted to respective hubs, and wherein the grippers extend from the hubs such that at least one gripper from each of said respective opposing sets of grippers are in operative engagement with the strip of dunnage when moving through the transfer region.

30. The dunnage conversion machine of claim 29, wherein the grippers of each set extend radially from the respective hubs.

31. The dunnage conversion machine of claim 29, wherein, along the transfer region portions of the respective circular paths of the sets of grippers, the at least one gripper from one set of grippers is longitudinally offset relative to the at least one gripper of the opposing set of grippers to provide clearance between the opposing grippers as the grippers move towards one another at the upstream end of the transfer region.

32. A dunnage conversion machine for converting sheet material into a dunnage product, comprising:

a forming assembly for shaping the sheet material into a continuous strip of dunnage including a three-dimensional shape; and a pulling assembly positioned downstream from the forming assembly for longitudinally advancing the sheet material through the forming assembly;

the pulling assembly including at least two opposed grippers, at least one of which is movable through a transfer region in transverse opposition to the other gripper and cooperative to grip therebetween the dunnage strip for advancing the dunnage strip through the transfer region, and at least one of the grippers including laterally spaced apart portions defining therebetween an aperture operative to gather and laterally capture therein the dunnage strip as the movable gripper moves through the transfer region, wherein the grippers are arranged in transversely opposed first and second sets of grippers connected to respective first and second gripper carriages disposed on opposite transverse sides of the transfer region; and the first gripper carriage being operative to move longitudinally the first set of grippers along a first non-circular path and the second gripper carriage being operative to move longitudinally the second set of grippers in synchronous relation to the first set of grippers along a second non-circular path, wherein portions of the first and second paths are juxtaposed to define therebetween the transfer region and wherein at least one gripper of the first set of grippers and at least one gripper of the second set of grippers are operative to transversely engage the strip of dunnage on opposite sides thereof for advancing the strip of dunnage through the transfer region.

33. The dunnage conversion machine of claim 32, wherein the transfer region comprises an engagement region whereat the first and second non-circular paths converge toward one another, an advancement region whereat the first and second non-circular paths are substantially parallel to one another, and a release region whereat the first and second non-circular paths diverge away from one another,.

34. A dunnage conversion machine for converting sheet material into a dunnage product, comprising:

a forming assembly for shaping the sheet material into a continuous strip of dunnage including a three-dimensional shape; and a pulling assembly positioned downstream from the forming assembly for longitudinally advancing the sheet material through the forming assembly;

the pulling assembly including at least two opposed grippers, at least one of which is movable through a transfer region in transverse opposition to the other gripper and cooperative to grip therebetween the dunnage strip for advancing the dunnage strip through the transfer region, and at least one of the grippers including laterally spaced apart portions defining therebetween an aperture operative to gather and laterally capture therein the dunnage strip as the movable grippers moves through the transfer region, wherein the pulling assembly includes first and second transfer elements and first and second series of wheels, wherein the first and second transfer elements are trained over the respective first and second series of wheels and include one or more grippers extending therefrom, the first and second series of wheels rotate in opposite directions and the first and second transfer elements are opposed to define the transfer region therebetween, whereby the grippers of the respective first and second transfer elements are progressively brought into opposing relation to engage and transfer the strip of dunnage through the transfer region.

35. The dunnage conversion machine of claim 34, wherein, as the first and second series of wheels rotate, the grippers of the respective first and second transfer elements converge toward one another at an upstream end of the dunnage transferring mechanism to engage opposite sides of the strip of dunnage, transfer the strip of dunnage through the transfer region, and then diverge away from one another at a downstream end of the dunnage transferring mechanism to release the strip of dunnage.

* * * * *

UNITED STATES PATENT AND TRADEMARK OFFICE

CERTIFICATE OF CORRECTION

PATENT NO. : 6,676,589 B2
APPLICATION NO. : 09/878130
DATED : January 13, 2004
INVENTOR(S) : Kurt Kung, Dieter Schwarz and Dan Coppus It is certified that error appears in the above-identified patent and that said Letters Patent is hereby corrected as shown below:

Column 25, line 1, “opposition” should read --opposed--.

Signed and Sealed this
First Day of February, 2011

David J. Kappos

David J. Kappos
*Director of the United States Patent and Trademark Office*